US005227701A

United States Patent [19]

McIntyre

[11] Patent Number: 5,227,701

[45] Date of Patent: Jul. 13, 1993

[54] GIGATRON MICROWAVE AMPLIFIER

[76] Inventor: Peter M. McIntyre, 611 Montclair, College Station, Tex. 77840

[21] Appl. No.: 195,198

[22] Filed: May 18, 1988

[51] Int. Cl.[5] ..... H01J 25/00

[52] U.S. Cl. ..... 315/5.41; 315/39.3; 315/39.53; 330/43

[58] Field of Search ..... 315/3.5, 3, 3.6, 4, 315/5, 5.41, 5.42, 39.3, 39, 39.53, 41, 43, 54, 61, 62; 313/309; 330/43, 44, 47; 331/82, 86

[56] References Cited

U.S. PATENT DOCUMENTS

| | | | |
|---|---|---|---|
| 2,333,295 | 11/1943 | Chevigny | 315/39 |
| 2,641,730 | 6/1953 | Touraton et al. | 315/3.5 |
| 2,695,929 | 11/1954 | Reverdin | 315/3.5 |
| 2,717,327 | 9/1955 | Touraton | 315/5.32 |
| 3,558,967 | 1/1971 | Miriam | 315/39.3 |
| 3,732,456 | 8/1973 | Buck | 315/3.5 X |
| 3,796,906 | 3/1974 | Henry-Bezy et al. | 315/5.42 X |
| 3,921,027 | 11/1975 | Shelton et al. | 315/5.39 |
| 4,145,635 | 3/1979 | Tuck | 313/309 X |
| 4,147,956 | 4/1979 | Horigome et al. | 315/3.6 |
| 4,229,717 | 10/1980 | Krone et al. | 333/156 |
| 4,298,824 | 11/1981 | Walsh | 315/3 X |
| 4,307,507 | 12/1981 | Gray et al. | 313/309 X |
| 4,313,072 | 1/1982 | Wilson et al. | 315/4 |
| 4,362,968 | 12/1982 | Chu et al. | 315/4 X |
| 4,513,308 | 4/1985 | Greene et al. | 357/55 |
| 4,545,056 | 10/1985 | Wortman et al. | 372/2 |
| 4,564,788 | 1/1986 | Wiehler | 315/3.6 |
| 4,571,726 | 2/1986 | Wortman et al. | 372/2 |
| 4,658,183 | 4/1987 | Huber | 315/3.5 |
| 4,682,076 | 7/1987 | Kageyama et al. | 315/4 |
| 4,721,885 | 1/1988 | Brodie | 313/576 |
| 4,780,684 | 10/1988 | Kosmahl | 313/309 |
| 4,901,028 | 2/1990 | Gray et al. | 330/54 |

OTHER PUBLICATIONS

Sessler, et al., "The Two-Beam Accelerator", LBL-21618 (Jun. 1986).

A. F. White, et al., "Mesotaxy: Single-Crystal Growth of Buried Silicide Layers", Appl. Phys. Lett., vol. 50, pp. 93-97 (1987).

C. A. Spindt, et al., "Field Emission Array Development", Proc. 33rd Int. Field Emission Sym. (1986).

Bizel, McIntyre, Raparia, Swenson, "Gigatron", Presented at the 1987 Workshop on New Developments in Particle Acceleration Techniques, Orsay, France, Jun. 29-Jul. 4, 1987.

Hasegawa, et al, "Properties of Microstrip Line on Si-$SiO_2$ System", IEEE Transactions on Microwave Theory and Techniques, Nov. 1971, pp. 869-881.

Bizel, McIntyre, Raparia and Swenson, "Gigatron", IEEE Transactions on Plasma Science, vol. 16, No. 2, Apr. 1988, pp. 258-263.

R. B. Palmer, "The Micro Lasertron", SLAC-PUB-3890 (Feb. 1986).

W. Lawson, et al., "A High Peak Power, X-Bond Gyroklystron For Linear Accelerators" Proc. 1986 Linac Conference.

C. K. Sinclair, "The SLAC Lasertron Project" SLAC-PUB-411 (Oct. 1986).

Y. Fukushima, et al., "Lasertron, A New Type of RF Source Using Photoemission Triggered by a Pulsed Laser Beam", Nucl. Inst. Meth. A 238, 215-219 (1985).

"New Technology For Linac Colliders", 1987 Progress Report, Principal Investigator, Peter M. McIntyre., Oct., 1987.

"New Technology For Linear Colliders", Supplemental Budger Request, Principal Investigator, Dr. Peter M. McIntyre. Mar. 1988.

*Primary Examiner*—Eugene R. Laroche

*Assistant Examiner*—Seung Ham

*Attorney, Agent, or Firm*—Michael F. Heim

[57] ABSTRACT

An electron tube for achieving high power at high frequency with high efficiency, including an input coupler, a ribbon-shaped electron beam and a traveling wave output coupler. The input coupler is a lumped constant resonant circuit that modulates a field emitter array cathode at microwave frequency. A bunched ribbon electron beam is emitted from the cathode in periodic bursts at the desired frequency. The beam has a ribbon configuration to eliminate limitations inherent in round beam devices. The traveling wave coupler efficiently extracts energy from the electron beam, and includes a waveguide with a slot therethrough for receiving the electron beam. The ribbon beam is tilted at an angle with respect to the traveling wave coupler so that the electron beam couples in-phase with the traveling wave in the waveguide. The traveling wave coupler thus extracts energy from the electron beam over the entire width of the beam.

30 Claims, 15 Drawing Sheets

GIGATRON MICROWAVE AMPLIFIER

RIGHTS OF THE GOVERNMENT

This invention was made with Government support under Contract No. DE-AC02-85ER40236 awarded by the Department of Energy. The Government has certain rights in this invention.

BACKGROUND OF THE INVENTION

The invention relates generally to a compact, efficient microwave electron tube. More particularly, the invention is a device capable of achieving high power at frequencies greater than 10 GHz.

There are a number of applications requiring a high frequency, high power microwave source, including, for example, a linac collider used in elementary particle physics research, aerospace communications, radar, military electronic counter-measures, military electronic warfare, and plasma heating for nuclear fusion (electron cyclotron resonance). Various technologies are currently being explored to provide a microwave source that operates at frequencies between 10 and 30 GHz, with a drive power of at least 100 Mw To date, however, no such microwave source is available.

Microwave tubes are commonly used in a variety of communication systems, radar systems, and heating systems. The two principal types of conventional microwave electron tube amplifiers include the klystron and the traveling wave tube. Referring now to FIG. 1, a prior art klystron microwave amplifier includes a cathode, a buncher cavity, a catcher or output cavity, and a collector. In the klystron, a dc electron beam is generated at the cathode and transmitted through the cavity gaps and through a cylindrical metal tube between the gaps. The area in the metal tubes defines a "drift space" for the electron beam, and each of the cavities is essentially a resonator. A low-level rf input signal is coupled to the first resonator, which is called the buncher cavity. A waveguide or a coaxial connection may be used to couple the rf signal to the buncher cavity. The cavity is tuned to the frequency of the rf input signal and is excited into oscillation. As a result, an electric field exists across the buncher gap, alternating at the input frequency. For half a cycle, the polarity of the electric field is such that it causes the velocity of the electrons flowing through the cavity gap to increase. During the other half cycle, the polarity of the electric field is such that it causes the electron velocity to decrease. For example, when the voltage across the gap is negative, the electrons may decelerate; when the voltage is zero, the electrons are unaffected; when the voltage is positive, the electrons are accelerated.

Referring now to FIG. 2, after leaving the buncher cavity the electrons proceed through the tube's drift region. In the drift region, the electrons that were accelerated through the buncher gap will overtake electrons that were decelerated. Consequently, the electrons begin to form into bunches by the time they reach the gap of the second resonator, which is called the catcher cavity. The time between the arrival of the sequential electron bunches is approximately the same as the period of the rf input signal.

According to conventional techniques, the initial bunch of electrons flowing through the catcher cavity (also sometimes called the output cavity) will cause the cavity to oscillate at its resonant frequency. As a result, an alternating electric field E oscillating at the desired frequency $E=E_o \cos(\omega t+\phi)$ is generated across the catcher cavity gap, where $E_o$ is the amplitude of the electric field, $\omega$ is the angular frequency of the field, t is time, and $\phi$ is the phase of the field. With proper design of the catcher cavity, the resonant frequency is such that each succeeding electron bunch that arrives at the catcher cavity gap encounters a decelerating electric field E that extracts most of the energy from the electrons, where $E_g=eV$ (g is the size of the gap; eV is the electron energy). If, however, electrons are out of phase and arrive at the catcher cavity when the polarity of the electric field across the gap is reversed, the electrons are accelerated, and energy is removed from the catcher cavity. In an effort to improve the bunching process, klystrons may be provided with intermediate cavities.

Some of the general limitations to the design of conventional klystron electron tubes are their large size, high operating voltages, and the complexity of associated equipment, such as that required for cooling and for providing magnetic guide fields.

Referring now to FIG. 3, a traveling wave tube includes a cathode, an anode, an input coupler, an external helix circuit, and an output coupler. The cathode produces a stream of electrons in a known configuration. The electrons are focused and confined into a narrow beam by an axial magnetic field, such as an electromagnet (not shown) which surrounds the helix portion of the tube. As the electrons pass through the helix, the narrow beam is accelerated by a high electric potential on the helix and the collector.

The beam in the traveling wave tube continually interacts with a varying electric field, emanating from an rf wave that propagates along an external circuit surrounding the beam. The propagating rf wave is generated from the longitudinal components of an rf signal received at the input coupler. To achieve amplification, the rf wave propagating on the external circuit has a phase velocity that is nearly synchronized with the velocity of the electron beam. Because it is difficult to accelerate the electron beam to more than about one-fifth the velocity of light, the forward velocity of the rf field propagating along the external circuit must be reduced to nearly that of the beam.

The phase velocity in a waveguide, which is uniform in the direction of propagation, is always greater than the velocity of light. However, this velocity may be reduced below the velocity of light by introducing a periodic variation of the circuit in the direction of propagation. The simplest form of variation is obtained by wrapping the circuit in the form of a helix which acts as a "slow wave" structure.

As explained previously, the electron beam is focused and constrained to flow along the axis of the helix. The longitudinal components of the input signal's rf electric field, along the axis of the helix or slow wave structure, continually interact with the electron beam to provide the amplification of the traveling wave tube.

If the electron beam velocity is exactly synchronized with the circuit's phase velocity, the electrons experience a steady electric force which tends to bunch them. In this case, as many electrons are accelerated as are decelerated; hence there is no net energy transfer between the beam and the rf electric field. To achieve amplification, the electron beam is adjusted to travel slightly faster than the rf electric field propagating along the helix. The bunching and debunching mechanisms are still at work, but the bunches now move slightly ahead of the fields on the helix. Under these conditions more electrons are decelerated than are accelerated, and energy is transferred from the beam to the rf field.

The fields may propagate in either direction along the helix. This leads to the possibility of oscillation due to the reflections back along the helix. This tendency is minimized by placing some resistive material near the input end of the slow wave structure. This resistance may take the form of a lossy attenuator to absorb any backward traveling wave. The forward wave is also absorbed to a great extent, but the signal is carried past the attenuator by the bunches of electrons. Since these bunches are not affected as they pass by the attenuator, they are capable of reinstituting the signal on the helix.

The rf signal may be removed from the traveling wave tube by a coaxial cable as in FIG. 3 or by a number of other ways, as shown in U.S. Pat. No. 4,682,076 issued to Kageyama, et al., U.S. Pat. No. 4,147,956 issued to Horeqome, et al., and U.S. Pat. No. 4,658,183, issued to Huber.

Both the klystron and the traveling wave coupler utilize a round dc electron beam. An rf wave is developed on the dc electron beam and the beam is then coupled to the modulated current in an output coupler. As a result, the klystron, the traveling wave tube and similar devices encounter fundamental performance limitations as frequency and power both increase, due primarily to the round beam geometry and the requirement of modulating a dc beam. The round beam geometry results in a space charge depression in the center of the beam. Space charge refers to the depression of the beam energy in the interior of a round beam compared to the energy of the electrons in the exterior part of the beam. The net result is that the interior of the round beam travels more slowly than does the exterior, producing a transit time spread in the acceleration and drift of the beam. The amount of space charge depression is proportional to beam current.

In high power applications, a high beam current magnifies the problem with space charge depression and causes a phase dispersion or phase spread in the electron bunch. In addition, as the frequency of the rf field increases (and the spacing between the electron bunches decreases), the effect of the phase spread becomes more significant. Consequently, as beam power and frequency increase, the electrons no longer bunch satisfactorily. Both the klystron and traveling wave tube have upper limits of about a few kilowatts of power at about 10 GHz.

Another problem with klystrons and traveling wave tubes occurs at high power and high frequency. Increasing beam current to achieve high power requires that beam size be increased, and as beam size increases, the input and output couplers must also be larger. As the beam size and the size of the couplers approach the wavelength of the rf signal, the coupler may have both a decelerating electric field and an accelerating electric field simultaneously and thus the phase of the coupling is different across the dimension of the beam. Consequently, extracting energy from the beam becomes far less efficient for a large beam size.

A final problem arises from the use of magnetic guide fields in the klystron and traveling wave tube. In conventional electron tubes, a magnetic field is used to guide the electron beam after it leaves the cathode. As the beam size increases, so too must the magnetic field in order to guide the larger beam. There is ultimately a limit to the beam size that can be successfully guided. In addition, the necessity of using magnets to guide the electron beam substantially increases the size and weight of the electron tube.

Several devices, including the gyroklystron, free-electron laser and the lasertron were developed recently in an effort to eliminate some of these inherent limitations to microwave amplifier performance. The prior art lasertron is a round beam device and encounters significant limitations at high power and high frequency due to space charge effects. The lasertron uses either a photocathode or a field emitter brush which is excited by a modulated laser beam. The photocathode generates a round electron beam with all of its inherent limitations. GaAs photocathodes have been used on several prototype lasertrons, but deteriorate in frequency response above 1 GHz, because the charge mobility is inadequate to clear the depletion depth during an rf cycle. Further, the modulated laser and photocathode have significant uncertainties rendering these units inappropriate for reliable continuous operation in most applications. Example of lasertrons are disclosed in U.S. Pat. No. 4,313,072, issued to Wilson, et al; C. K. Sinclair, SLAC-PUB-4111 (1986); Y. Fukushima, et al., Nucl. Instr. Meth. A238, 215 (1985); and R. B. Palmer, SLAC-PUB-3890 (1986).

A free electron laser requires extremely high beam brightness for efficient operation and requires a formidable infrastructure of accelerator equipment. An example of a free electron laser is disclosed in U.S. Pat. No. 4,571,726, issued to Wortman, et al, and in A. M. Sessler and D. B. Hopkins, LBL-21618 (1986).

The gyrotron and gyroklystron couple to gyromotion of an electron beam, and are capable of generating megawatts of output power at frequencies greater than 10 GHz. The gyrotron operates as an oscillator, while the gyroklystron is stabilized to operate as an amplifier. Both devices suffer from intrinsic phase instability for applications requiring phase control. In addition, both devices require large, complex electromagnets to provide an appropriate guide field, and both devices are sensitive to variations in load impedance. An example of a gyroklystron may be found in W. Lawson et al., "A High Peak Power, X-Band Gyroklystron for Linear Accelerators," Proc. 1986 Linac Conference.

To date, no one has successfully developed a compact, efficient microwave source to operate at a frequency above 10 GHz with approximately 100 MW.

SUMMARY OF THE INVENTION

Accordingly, the present invention comprises a microwave power amplifier tube, called a gigatron, in which a bunched electron beam with a ribbon-shaped configuration is emitted from a modulated cathode. The emitted beam is fully modulated by a field emitter array cathode at high frequency without the requirements of a modulator and drift region that characterize all conventional amplifier tubes. The beam is accelerated through a constant-potential diode structure and then enters a drift slot leading to the output coupler. RF energy is then extracted from the beam in the output coupler which generally comprises a slotted waveguide connected to form a loop resonant circuit.

A traveling wave generated in the output coupler provides a decelerating electric field in the waveguide. The waveguide slot is configured to permit passage of the ribbon beam through the waveguide, parallel to the electric field of the traveling wave. The electron beam is decelerated by the wave, and thereby drives the wave amplitude. Optimum phase matching between the output coupler and the electron beam is maintained over an arbitrary beam width by adjusting the angle of incidence of the electron beam with respect to the output coupler. By a suitable matching condition, the electron packet can be made to pass through each point of the coupler slot at the same time the traveling wave is traversing the waveguide. Thus, the beam velocity is matched to the traveling wave phase velocity, enabling the beam to "surf", or be in phase, with the wave.

The gigatron therefore includes a) low-loss coupling of input power to the field emitter array structure; b) elimination of space-charge limits to high power/high frequency that attend all round-beam devices; c) provision of optimum output coupling over a wide beam front; d) elimination of the requirement for static guide fields that characterize nearly all high frequency power tubes; e) natural suppression of parasitic modes; and f) a simple, compact structure. As a result, the gigatron provides high power and high frequency with high efficiency (above 70 percent) that is unparalleled by any other known device.

In an alternative embodiment, for medium power applications, a microwave amplifier tube, called a megatron, utilizes a modulated field emitter cathode to emit a bunched electron beam with a round beam configuration. Energy is extracted from the round beam as disclosed in U.S. Pat. No. 4,313,072.

The above and other objects and features of the present invention will be apparent from the following description of a preferred embodiment of the invention with reference to the accompanying drawings.

DESCRIPTION OF THE PREFERRED EMBODIMENT

The gigatron of the present invention comprises a design for an electron tube capable of generating high power at high frequency with high efficiency. In the preferred embodiment, the gigatron includes a resonant input coupler to modulate a field emitter cathode at microwave frequency. Field emitter cathodes are well known in the art to modulate dc electron beams as disclosed in U.S. Pat. No. 4,307,507, issued to Gray, et al and U.S. Pat. No. 4,513,308 issued to Green, et al., both of which are incorporated herein by reference. It should be noted, however, that U.S. Pat. No. 4,513,308 will not provide enough current if the array is reverse-biased with a p-n junction at the emitter. The field emitter array may be fabricated according to U.S. Pat. No. 4,307,507 or U.S. Pat. No. 4,513,308. The resonant input coupler and appropriate modification of prior art cathode fabrication enables modulation of the field emitter cathode at microwave frequency.

The preferred embodiment of the gigatron further utilizes a ribbon electron beam configuration to transport large total beam power from cathode to output coupler while preserving the microwave modulation of the beam current. The gigatron also preferably includes a traveling wave coupler that efficiently extracts energy from the modulated ribbon electron beam.

Figure 1:
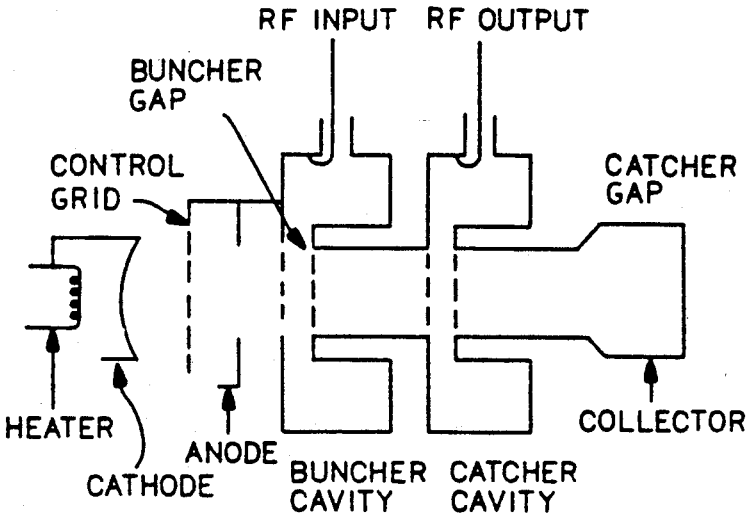
FIG. 1 (PRIOR ART)
FIG. 1 illustrates schematically a prior art klystron microwave amplifier.
Figure 4:
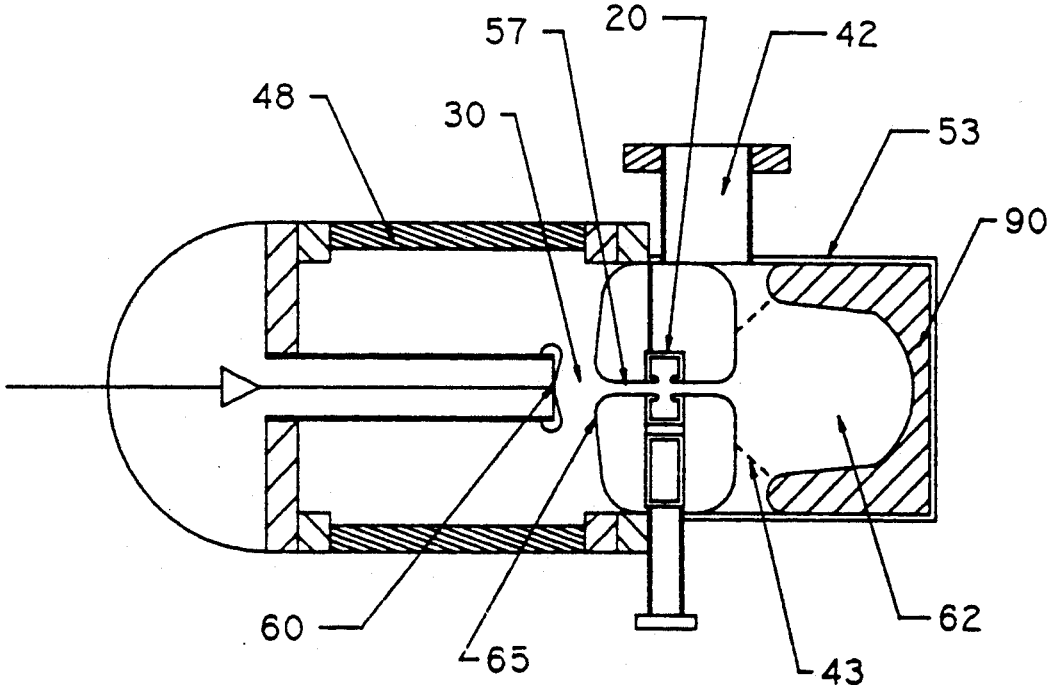
FIG. 4 is a cross-sectional side view of a gigatron structured in accordance with the principles of the present invention.
Figure 3:
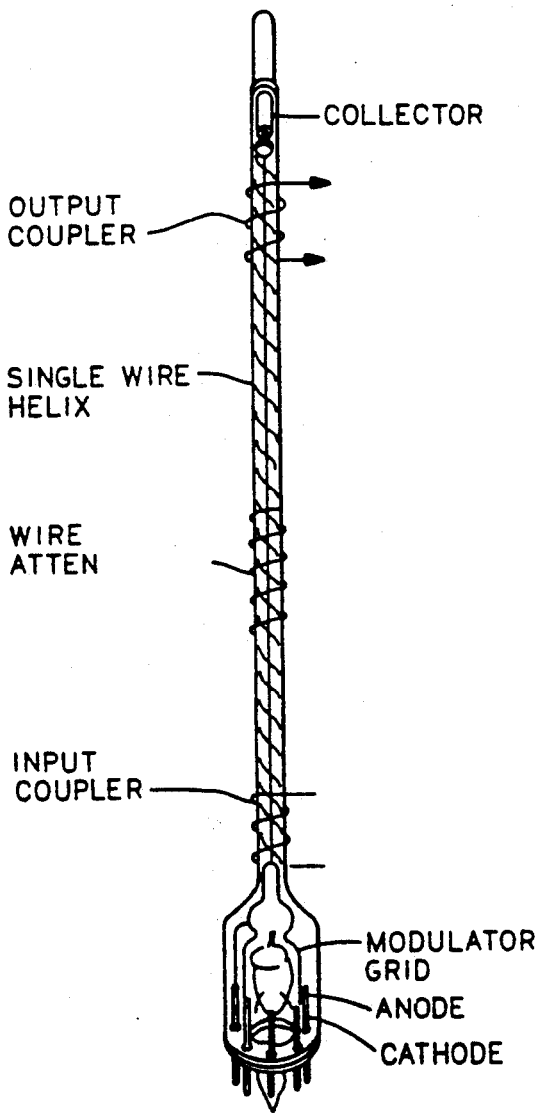
FIG. 3 (PRIOR ART)
FIG. 3 is an illustration of a prior art traveling wave tube.
Figure 2:
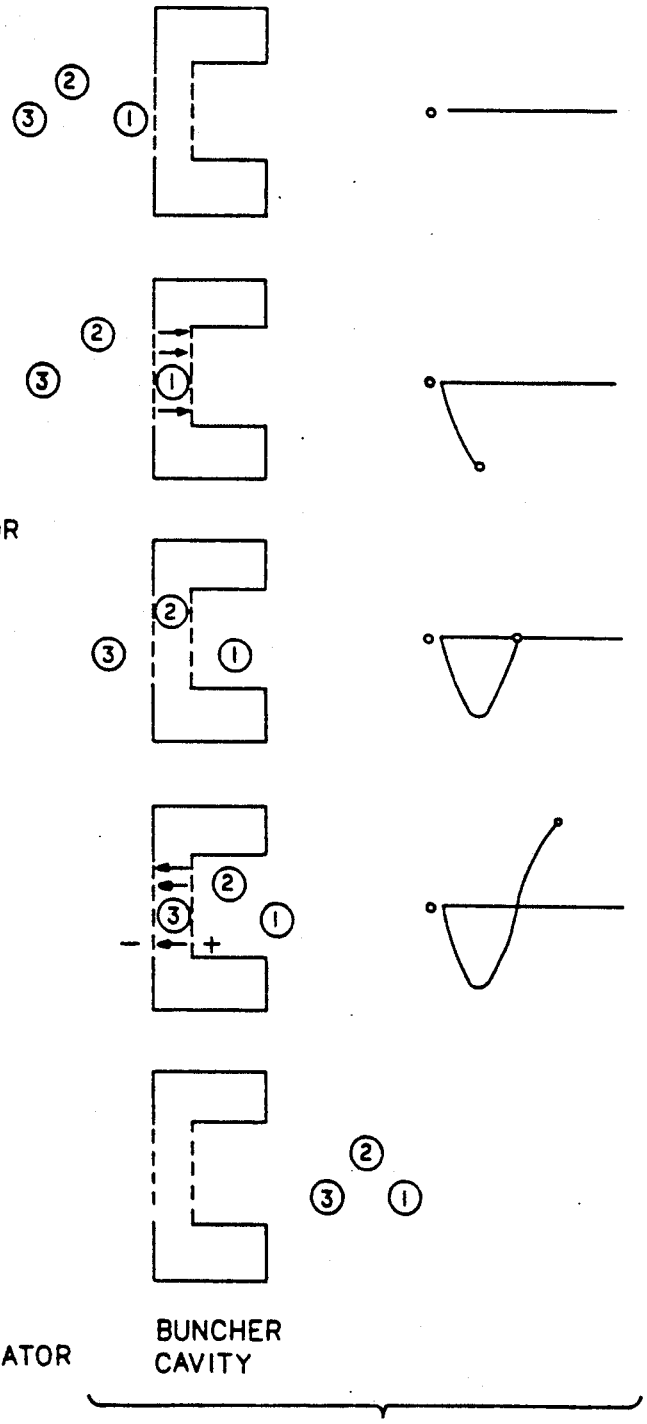
FIG. 2 (PRIOR ART)
FIG. 2 is a diagram illustrating the operation of a catcher cavity of the prior art klystron shown in FIG. 1.

Referring now to FIG. 4, the gigatron 200 constructed in accordance with the principles of the present invention includes a cathode 60, anode 65, output coupler 20 and collector 90 housed in a vacuum chamber 62.

Cathode 60 emits electrons in pulses determined by a cathode modulator or resonant input coupler 50, as described more fully herein. Each electron pulse passes through anode 65, which may comprise a conventional rectilinear diode for accelerating the electron beam. An example of a rectilinear diode may be found, for example, in J. R. Pierce, *Theory and Design of Electron Beams*, D. Van Nostrand, Princeton (1954). The beam continues through a drift channel 57 and enters the output coupler 20, wherein energy is extracted from the electron beam by an rf wave traveling in the coupler. After exiting from output coupler 20, the electron beam is collected by a conventional collector structure 90. A mesh screen 43 separates the collector and diode region electrically to prevent regenerative feedback.

Vacuum pump 42 maintains the environment within vacuum chamber 62 and prevents the ambient environment from altering the course of the electron beam as it traverses from cathode 60 to collector 90. The gigatron 200 is housed within a metal housing 53 that insulates the gigatron from adverse electric and magnetic fields. A ceramic insulator 48 is used to permit dc high voltage to be applied between cathode 60 and anode 65.

The gigatron preferably includes a modified gated field emitter array, a resonant input coupler, a ribbon electron beam and a traveling wave coupler. However, a new and useful electron tube may be constructed without including all of these novel components. In addition, each of the novel components includes various alternative embodiments. The following discussion will focus on some of the available embodiments of the novel components, with the realization that many other structures may be developed without departing from the principles of this invention. Finally, an alternative to the gigatron will be described which utilizes the resonant input coupler but not the ribbon electron beam or traveling wave coupler, as an example of a device that may be constructed without utilizing all of the novel components disclosed herein.

Referring now to the drawings wherein like reference numerals designate identical or corresponding parts, the gated field emitter cathode, the resonant input coupler, the ribbon electron beam and the traveling wave coupler will be described in accordance with the preferred embodiment of the gigatron.

All quantitative results obtained in this disclosure relate to the particular design choice of frequency equal to 18 GHz, and power output equal to 10 MW, with design parameters indicated in Table I.

TABLE I

| Parameters of Example Gigatron | | |
|---|---|---|
| $\omega/2\pi$ | rf frequency | 18 GHz |
| $P_o$ | rf peak power | 10 MW |
| G | power gain | 27 dB |
| | rf efficiency | 74% |
| V | beam voltage | 200 kVDC |
| I | peak beam current | 390 A |
| $\phi$ | rf phase | 230° |
| $\Delta\phi$ | beam phase width | 60° |
| l · w | cathode size | 14 × .1 cm$^2$ |
| a · b | waveguide coupler (WR42) | 1.1 × .4 cm$^2$ |
| g,h | slot width, height | .2 cm, .3 cm |
| $\beta_e$ | electron velocity/c | .70 |
| $\beta_p$ | phase velocity/c | 1.37 |
| $\Theta$ | ribbon tilt angle | 27° |
| $\Psi$ | magnetic bend angle | 22° |
| $E_o$ | peak rf field | 125 MV/m |

The parameters chosen are merely for illustration purposes and are not the only parameters at which the gigatron will operate. The gigatron readily accommodates frequencies from 10 to 30 GHz with peak power levels from 10 kW to 100 MW.

I. FIELD EMITTER ARRAY

The cathode 60 of the gigatron 200 includes a resonant input coupler to modulate a field emitter array at microwave frequency. As a result, electrons are emitted from the field emitter array in bunches and are spaced according to the desired frequency.

As disclosed in U.S. Pat. No. 4,513,308, issued to Greene et al.; U.S. Pat. No. 4,307,507, issued to Gray et al.; U.S. Pat. No. 4,721,895, issued to Brodie; and C. A. Spindt et al., "Field Emission Array Development", Proc. 33rd Int. Field Emission Sym. (1986), a field emitter array may be used to greatly increase the packing density of emitter tips in a field emission cathode array and to provide extremely uniform tip geometry. The primary problem with the prior art field emitter cathodes is that they present highly capacitive loads with a low impedance which is extremely difficult to match at high frequency, thus rendering field emitter arrays inefficient as microwave cathodes.

Referring to FIGS. 5A, 5B, 6A, 6B and 7, the preferred field emitter array cathode constructed in accordance with the present invention comprises an n-doped silicon substrate 144, a rectangular planar array of equally-spaced gated field emitter tips 137, fabricated on the n-doped silicon substrate 144, and a multi-layer gate structure 162. Surrounding each emitter tip 137 is the gate structure 162, comprising a base electrode layer 154, an insulating layer 158 and a gate electrode 141. The base electrode layer 154 is deposited on the silicon substrate 144 and preferably comprises a one micron thick aluminum film. The insulating layer 158 is deposited on the base electrode 154, and preferably comprises a 1.5 micron thick silicon dioxide film. The gate electrode layer 141 is deposited on the insulating layer 158, and preferably comprises a one micron thick gold film. The field emitter array extends the entire length l of the cathode, but in the preferred embodiment is divided into segments of equal length x. Contiguous segments are electrically and mechanically isolated by provision of a narrow gap (−2 μm). The segment length x is preferably 5 mm.

The fabrication of the field emitter array cathode follows closely the procedure of U.S. Pat. No. 4,307,507. The fabrication sequence for the preferred embodiment of the present invention differs from U.S. Pat. No. 4,307,507, in that (1) a metal base layer 154 is provided to distribute current to the tip array with minimum electrical resistance and power loss; (2) the metal base layer 154 comprises a different metal from that of the gate layer; and (3) thereby, a sequence of layer-specific etching steps can produce the contour shown in FIG. 7 surrounding each field emitter tip 137.

Figure 6A:
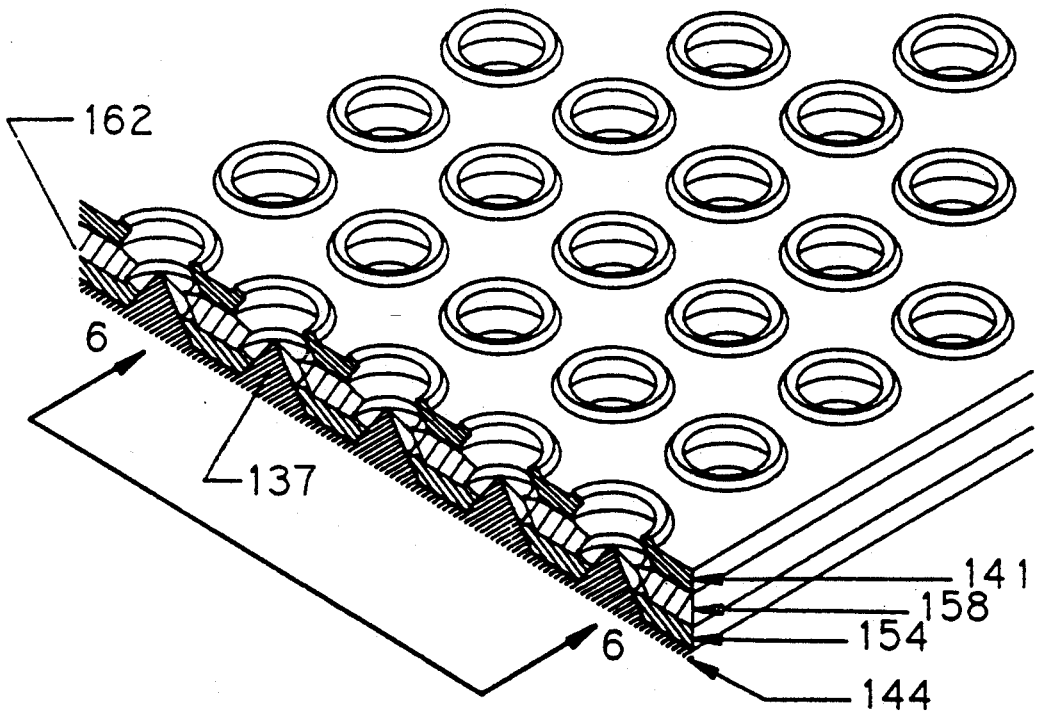
FIG. 6A is an isometric view of a field emitter array of the cathode structure shown in FIG. 5.
Figure 6B:
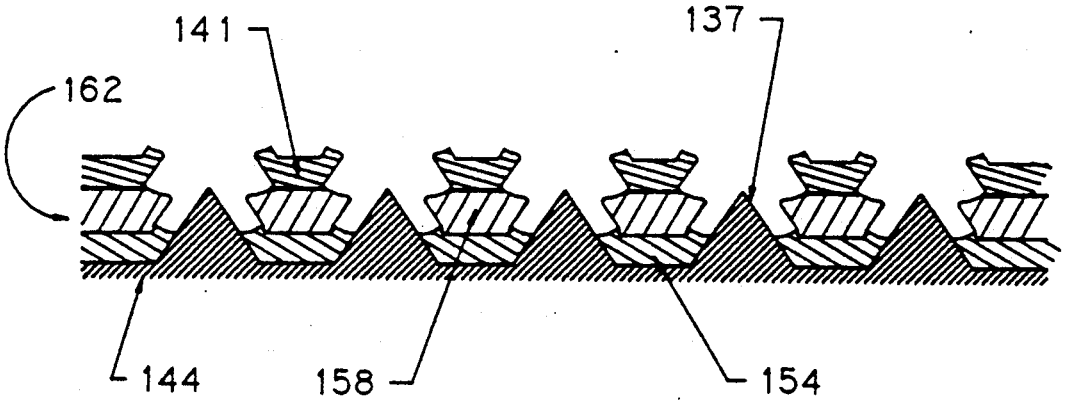
FIG. 6B is a side elevation of the field emitter array taken along a line 6—6 in FIG. 6A.
Figure 7:
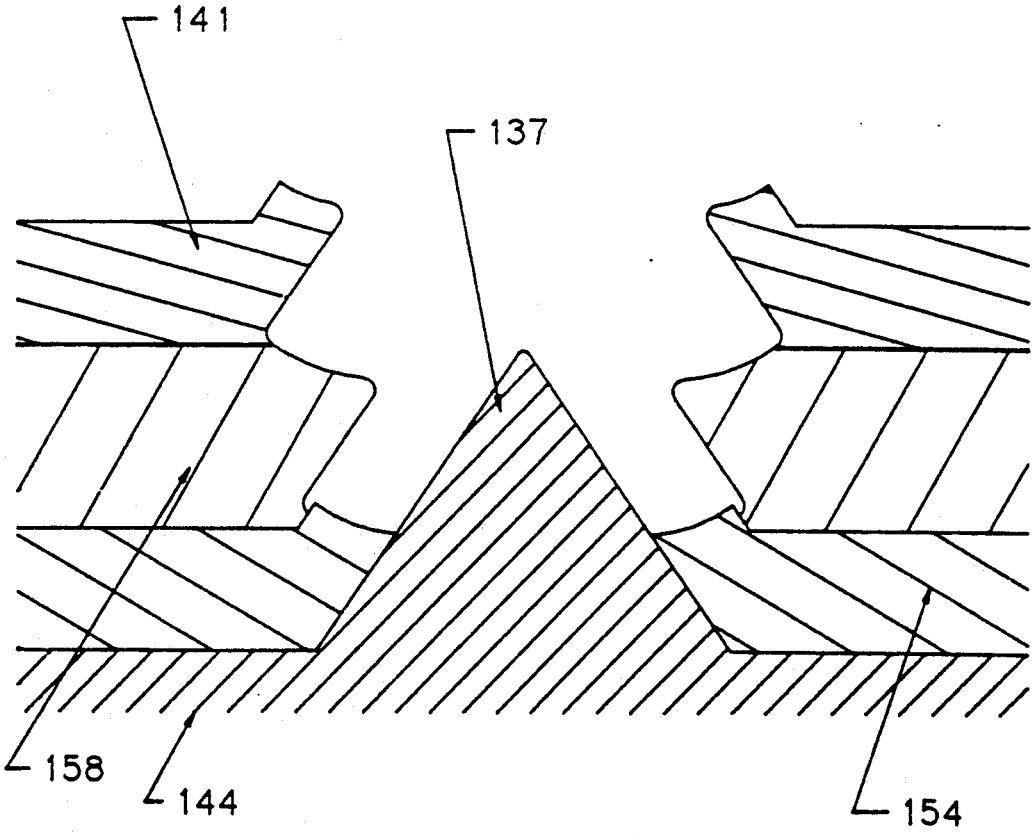
FIG. 7 is a side elevation of a portion of the field emitter array shown in FIG. 6B.

Each emitter tip 137 is a four-sided pyramid of silicon with a square base of three microns and a height of 2.5 microns. As shown in FIG. 6, all tips 137 electrically contact base electrode 154. The tip of each pyramid has a radius of curvature of approximately 50 nm. The emitter tips 137 are arranged in regular rows and columns, as shown in FIG. 6A. The preferred tip-to-tip spacing is six microns.

Figure 8:
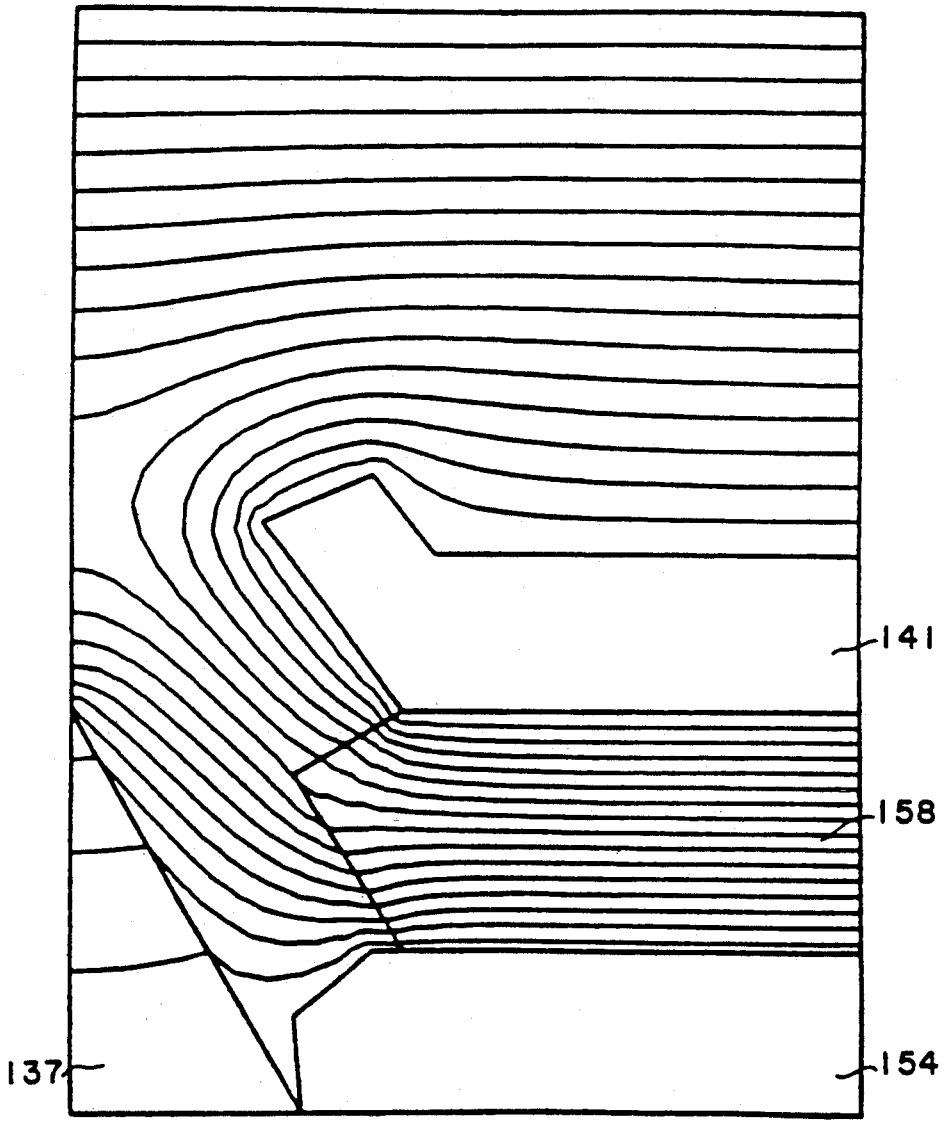
FIG. 8 shows the calculated distribution of electric potential in the vicinity of the field emitter tip shown in FIG. 7.

In operation, a voltage $V_g$, generated between base electrode 154 and gate electrode 141, produces field emission of electrons from the tips 137. FIG. 8 shows the calculated electric potential in the region of the emitter tip 137 resulting from the application of a gate voltage $V_g$=200 V. The emission beam current i produced from the emitter tips 137 is controlled by the voltage $V_g$ through the application of the Fowler-Nordheim relation $$i = \frac{V_g^2}{Z_o V_o} e^{-V_o/V_g}$$

Figure 9:
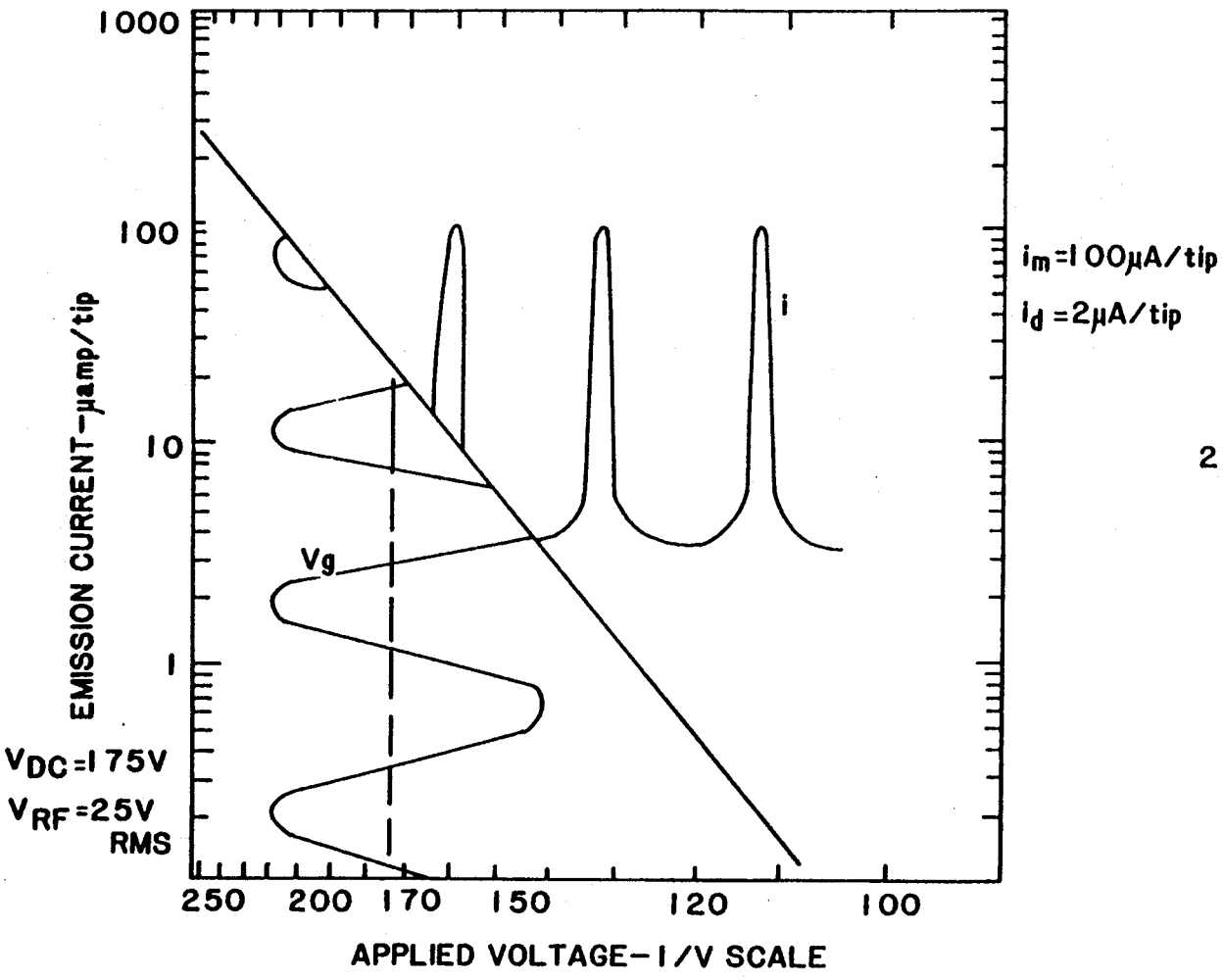
FIG. 9 is a graph of applied voltage versus current emitted from the cathode shown in FIG. 4.

The parameters in the Fowler-Nordheim relation are:

$Z_o$=377Ω, the vacuum impedance;

$V_o$ is the scale voltage of the emission process, which is geometry-dependent. FIG. 9 shows a plot of the Fowler-Nordheim relation for one emitter tip 137 in the tip geometry of FIG. 6 estimated from the experimental data of C. A. Spindt, et al, referred to supra. Also shown in FIG. 9 is the effect of a gate modulation $V_g = V_d + V_m \cos \omega t$, where $V_d = 175$ V is the dc bias, and $V_m = 35$ V is the rf modulation amplitude.

The resulting emission current is approximately a square pulse modulation, with an on-dwell phase ($\Delta\phi$) of about 60 degrees, a peak current ($i_m$) equal to 100 $\mu$A/tip and a constant leakage current ($i_d$) of approximately 2 $\mu$A/tip. For a field emitter cathode having a six micron tip spacing and a cathode size of (14 cm × 1 mm), a peak emission current (I) of 390 A is obtained. Thus, the electron beam parameters given in Table I are provided by the field emitter array cathode.

Figure 11:
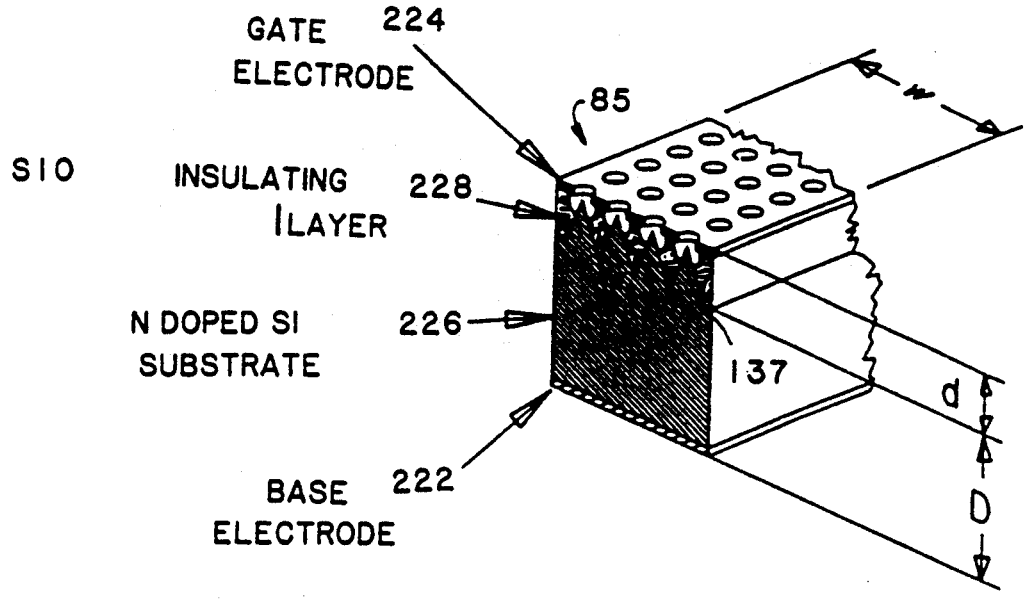
FIG. 11 is an isometric view of an alternative embodiment of the cathode structure utilizing a semiconductor stripline.

In an alternative embodiment shown in FIG. 11, the silicon semiconductor substrate, including the emitter tips, may be implanted with cobalt to form a layer of cobalt disilicide $CoSi_2$ along the surface layer of the silicon. The layer of cobalt disilicide has a conductivity that approaches that of gold, and would reduce possible losses in supplying current from the base layer to the emitter tip, as discussed in A. E. White, et al., "Mesotaxy: Single-Crystal Growth of Buried $CoSi_2$ Layers", Appl. Phys. Lett., Vol. 50, pp. 95-97 (1987).

When a ribbon electron beam configuration is employed, the field emitter array cathode 60 has a length l which is much greater than the height w. The field emitter array 85 includes an emitting surface 186 and a gate boundary 88. Gate boundary 88 is a continuation of the gate layer metalization (containing no field emitter tips) with a width of approximately 0.1 mm that is positioned along each edge of the field emitter array to provide for ultrasonic bonding of inductive element 205. Gate boundary 88 extends along the entire length l of the array 85. Like gate electrode 141, gate boundary 88 is deposited on insulating layer 158.

II. RESONANT INPUT COUPLER

Figure 5A:
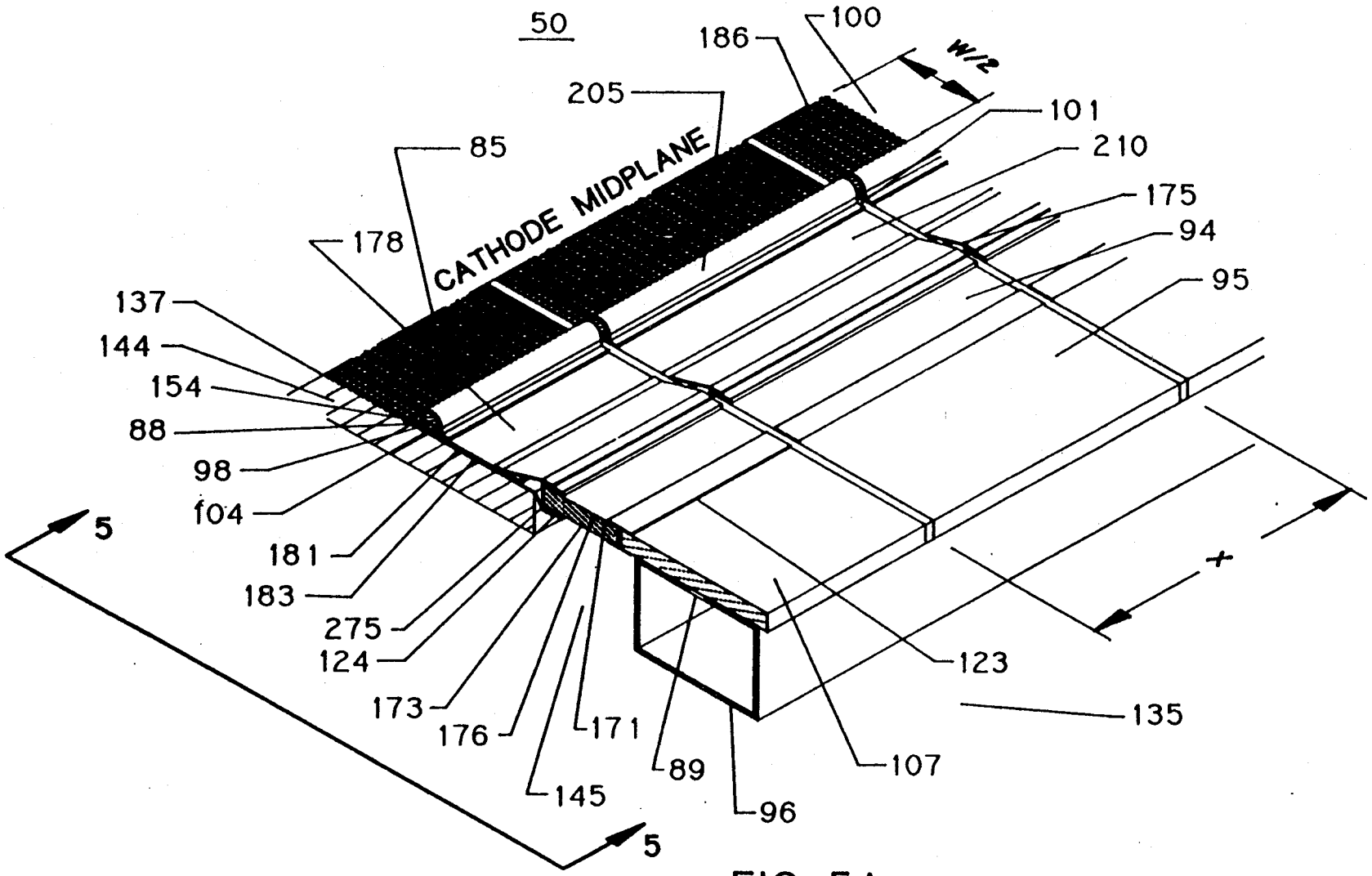
FIG. 5A is an isometric view of a cathode structure of the gigatron shown in FIG. 4.

Referring now to FIG. 5A, the cathode 60 of the preferred embodiment includes a resonant input coupler 50 which is used to efficiently generate the gate modulation $V_m \cos \omega t$ upon the highly capacitive load represented by the field emitter array 85. The resonant input coupler 50 optimizes coupling by configuring the cathode 60 as a sequence of coupled lumped—constant resonant circuits.

Figure 5B:
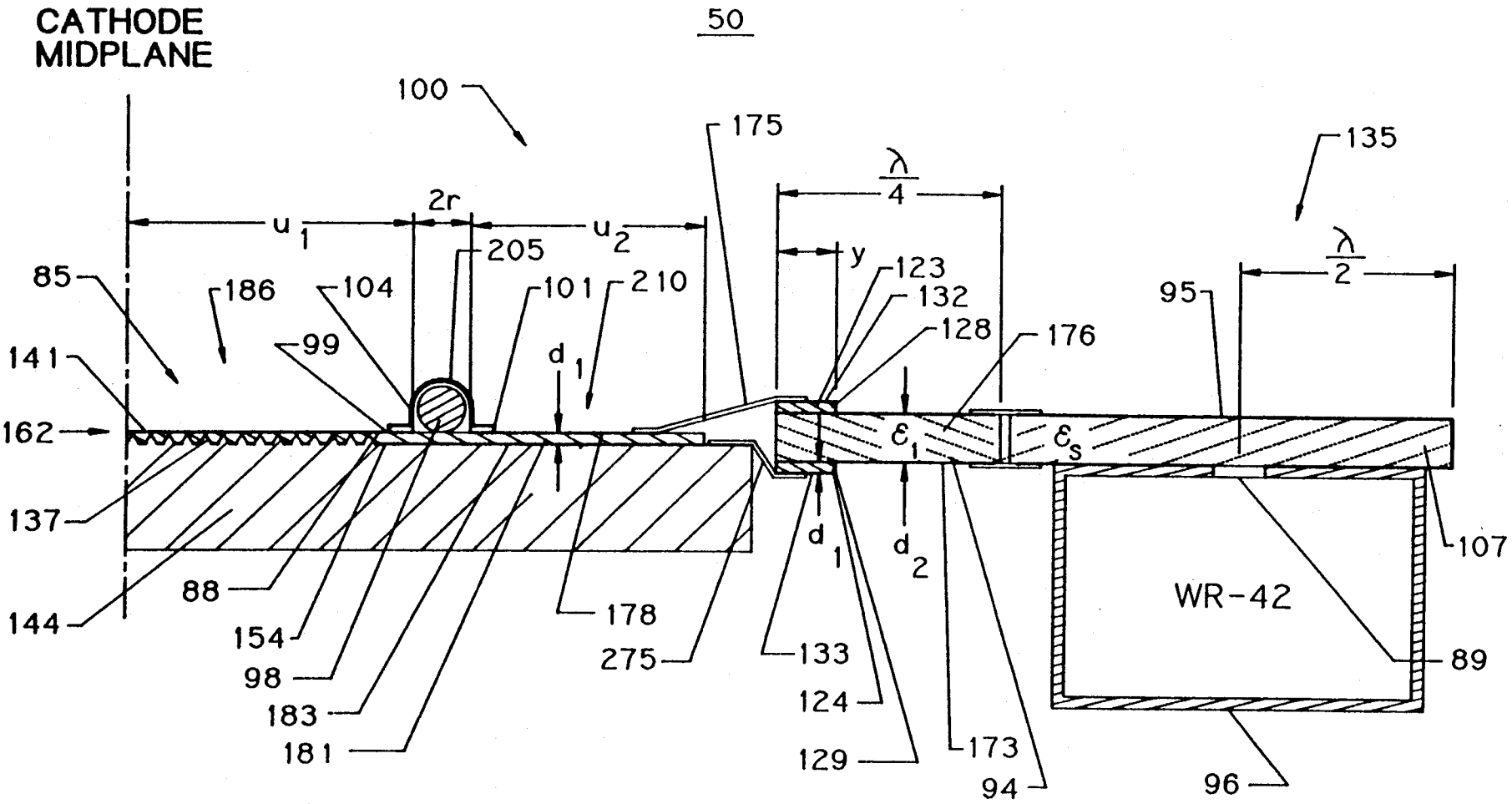
FIG. 5B is side elevation of the cathode structure in a cross-section taken along a line 5—5 in FIG. 5A.
Figure 10:
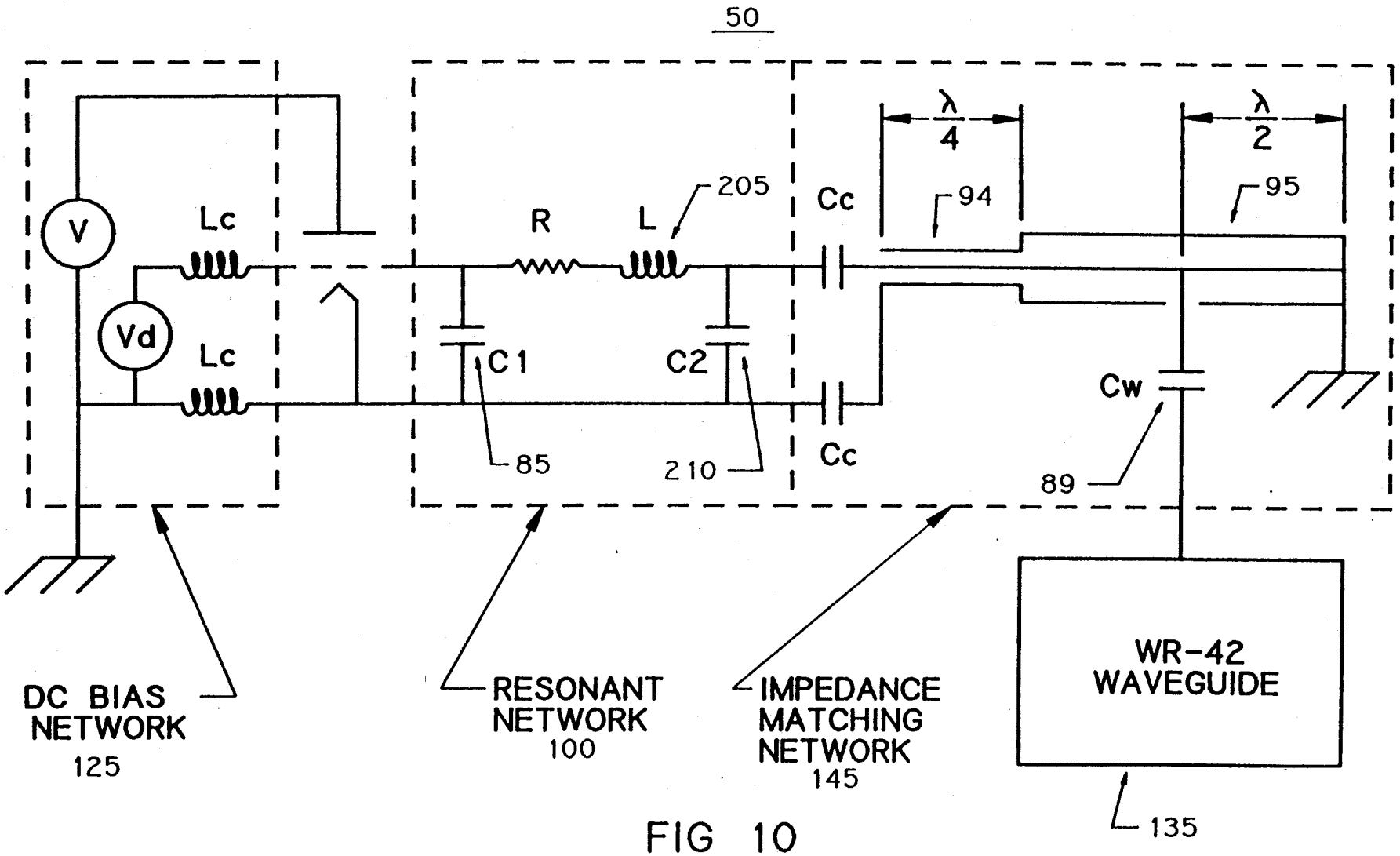
FIG. 10 is an equivalent circuit of the field emitter array, bias network, and resonant input coupler.

Referring to FIGS. 5A, 5B and 10, the resonant input coupler 50 constructed in accordance with the preferred embodiment includes a resonant network 100, a dc bias network 125 to provide a dc offset for the network 100, an rf source 135 and a transmission line 145 for delivering the signal from source 135 to network 100. The resonant input coupler 50 includes a coupler structure that is deposited on the semiconductor substrate 144 by means of microfabrication techniques. By mounting the coupler structure to the substrate 144 and array 85, the power required to modulate the gate structure 162 of the array 85 is minimized.

More particularly the resonant network 100 comprises an inductive element 205 with an inductance L, a tuning capacitor 210 with a capacitance $C_2$, and the field emitter array 85, described supra, with a capacitance $C_1$. The resistance R is the effective resistance to current flow within resonant network 100. All elements of the resonant network 100 are segmented in equal lengths x which are aligned with the segments of the field emitter array 85.

Inductive element 205 is a metalized quartz fiber 98 with a generally circular cross section located adjacent to gate boundary 88. Gate layer metalization is interrupted in the region beneath inductive element 205, so that rf currents to and from the gate electrode 141 must flow around the metalized surface of inductive element 205. Fiber 98 includes a metal surface 104, preferably of gold and has a length l and a diameter of 2r, which is chosen to provide an inductance L that resonates with the network 100 at the chosen frequency. Both the array 85 and the inductive element 205 are interrupted in narrow strips to electrically segment the inductive element in equal lengths x, as discussed supra. The required inductance in each segment is $$L = \mu_o \pi r^2 / x$$

where $\mu_o = 4\pi \times 10^{-7}$ is the vacuum permeability.

Inductive element 205 is fixedly attached to the gate boundary 88 of array 85 by ultrasonically bonding metal surface 104 to gate layer along seam 99.

The tuning capacitor 210 extends along the length l of array 85 and has a sandwich construction with a top plate 178, an insulating layer 181 and a bottom plate 183. The tuning capacitor 210 is divided into segments of equal length x and is spaced across inductive element 205 from the field emitter array with bottom plate 183 electrically connected to the base layer 154 of array 85. Insulating layer 181, with a thickness $d_1$, is deposited on bottom plate 183 and preferably is contiguous with inductive layer 158 of array 85. Top plate 178 is deposited on insulating layer 181. The inductive element 205 is fixedly attached to top plate 178 of capacitor 210 by ultrasonically bonding metal surface 104 to top plate 178 along seam 101.

Field emitter array 85, inductive element 205, tuning capacitor 210, and gate connector 88 define a resonant circuit as shown in FIG. 10, with an effective resistance R to the rf currents flowing in the resonant circuit. DC bias voltage $V_d$ is applied through a conventional rf choke $L_c$, which appears as an approximate open circuit at rf frequency. The rf current required to modulate the gate structure 162 is provided by the resonant network 100 formed by $C_1$, L, and $C_2$. These resonant networks are located along each side of the strip cathode, and segmented into equal lengths x. Each cathode segment is thus driven separately from its left and right sides by a resonant network 100. The capacitance $C_1$ is that due to the gate structure 162 and is quite large. For each lateral half-segment of the cathode, there is a capacitance $$C_1 = \epsilon_1 x u_1 / d_1$$

where $\epsilon_1 = 4\,\epsilon_o$ is the dielectric constant of the insulator layer 158;

$\epsilon_o = 9 \times 10^{-12}$ is the vacuum permittivity;

x = 5 mm is the length of a cathode segment;

l = 14 cm is the total length of the cathode;

$u_1 = 0.6$ mm is the half-width (including gate boundary 88) of a cathode segment;

$d_1 = 1.5$ $\mu$m is the thickness of the insulator layer 158.

The tuning capacitance $C_2$ can in general be chosen to be different from $C_1$. For the preferred embodiment, however, a capacitance is chosen where $C_2 = C_1$; thus capacitor 210 has the same width ($u_1$), length (x), gap ($d_1$) and insulator dielectric ($\epsilon_1$) as does the gate structure 162 of the field emitter array. This choice simplifies fabrication, since capacitor 210 is then just an extension without emitter tips of the base/insulator/gate layers of the field-emitter array.

The equivalent capacitance $C_o$ of the resonant capacitive network 100 is $$C_o=[C_1^{-}+(C_2+\tfrac{1}{2}C_c)^{-1}]^{-1}$$

Resonance occurs at an angular frequency $\omega$ $$\omega=\frac{1}{\sqrt{LC_o}}$$

The resistance R in the equivalent circuit is the effective series resistance to current flow in the resonant circuit. For the current flow path in FIG. 7, the resistance is $$R=(3^4u+2\ \pi r)\ R_s/x$$

where $R_s=0.04\ \Omega$/square is the surface resistance of gold (and aluminum) at 18 GHz.
The Q of the resonant circuit is $$Q=(\omega C_oR)^{-1}$$

Referring to FIG. 10, the resonant circuit is driven by coupling rf current to the plates of capacitor $C_2$ through coupling capacitor $C_c$ from a suitably matched transmission line 145.

Figure 5C:
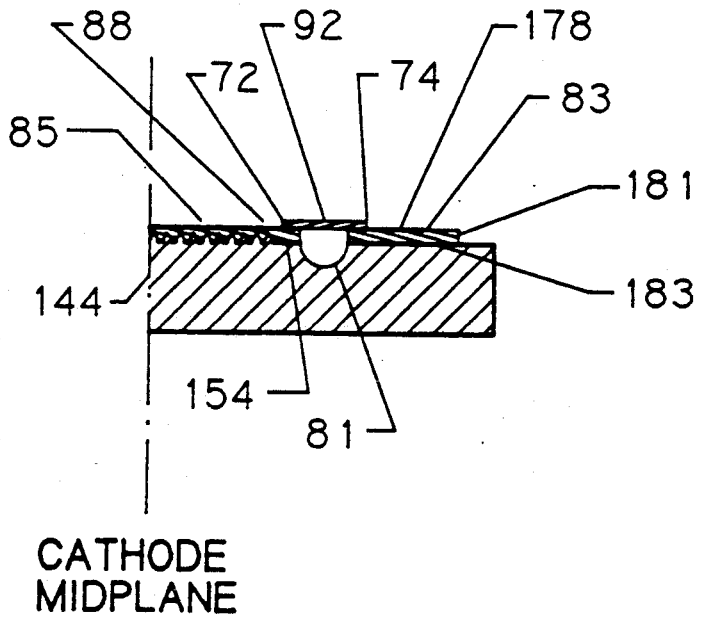
FIG. 5C is a side elevation of an alternative embodiment of the resonant network with an inductive channel.

Referring now to FIG. 5C, an alternative embodiment of the resonant network 100 comprises inductive channels 81, with an inductance L, along the sides of field emitter array 85, tuning capacitors 83, bridge electrodes 92, and stripline launchers (not shown). Inductive channels 81 define grooves extending along the upper and lower edges of array 85, with a semi-circular cross-section that has a radius r. Channels 81 are metalized with gold and extend along the length l of the emitter array 85, segmented in equal lengths x. The metalized surface of channel 81 electrically connects to the base layer 154 of field emitter array 85 and to the bottom plate of capacitor 83.

Tuning capacitor 83 with a capacitance $C_2$ extends along the length l of array 85 and has a sandwich construction with a top plate 178, an insulating layer 181 and a bottom plate 183. Tuning capacitor is spaced across channel 81 from the field emitter array with bottom plate 183 electrically connected to the metalized surface channel 81. Insulating layer 181, with a thickness $d_1$, is deposited on bottom plate 183. Top plate 179 rests on insulating layer 181. Underlying field emitter array 85, channel 81, and capacitor 83 is the semiconductor substrate 144.

Bridge electrode 92 electrically connects the tuning capacitor 83 to the field emitter gate electrode 141, and comprises a sequence of rectangular strips of gold foil with a length equal to the length l of the array 85, and width adequate to bridge the inductive channel. Bridge electrode 92 preferably is divided into segments of equal length x and covers the inductive channel 81. Bridge electrode includes an inner edge 72 that is ultrasonically bonded to gate boundary 88 of the array 85 and an outer edge 74 ultrasonically bonded to the top plate 179 of tuning capacitor 83.

Referring again to the preferred embodiment of FIGS. 5A, 5B and 10, the coupling capacitance $C_c$ is chosen for critical coupling:

$$C_c=2C_2\left[\frac{1}{C_2R\omega}-1\right]^{-1}$$

The resulting load impedance $Z_L$ presented to the transmission line 94 is $$Z_L=\frac{1}{(1+i)}\ \frac{R}{(C_2R\omega)^2}$$

Using the parameters of Table I, the resonant network 100, divided into segments x=5 mm, has:

$C_1=C_2=72$ pF
$C_c=11$ pF
$L=2.2$ pH
$r=50\ \mu m$
$R=9\times10^{-3}\ \Omega$
$Q=28$
$Z_L=2.0\ \Omega$ Transmission line 145 carries the rf signal generated by the rf source 135 to the resonant network 100 and comprises a segment of stripline 94 and a pair of coupling capacitors 123, 124, each with a capacitance of $C_c$. The stripline 94 is a three layer structure with a top conducting plate 171, a dielectric 176 with a thickness $d_2$ and dielectric constant $\epsilon$, and a bottom conducting plate 173. In the preferred embodiment, calcium titanate is used as the dielectric 176 of stripline 94, with $\epsilon_s=160$.

Coupling capacitor 123 comprises a layer of silicon dioxide 128 deposited on top conducting plate 171 of stripline 94, and a metal plate 132 deposited on silicon dioxide layer 128. Plate 132 is electrically connected to top plate 178 of tuning capacitor 210 by means of a gold strip 175 which is ultrasonically bonded to both plates.

Coupling capacitor 124 comprises a layer of silicon dioxide 129 deposited on bottom plate 173 of stripline 94 and a metal plate 133 deposited on silicon dioxide layer 129. Metal plate 133 is electrically connected to the bottom plate 183 of tuning capacitor 210 by means of a gold strip 275 which is ultrasonically bonded to both plates. The thickness of silicon dioxide layers 128, 129 is given as $d_1$ which is preferably 1.5 microns. Metal plates 132, 133 preferably are comprised of gold, with a face area of width y, thickness 1 $\mu$m, and length l, divided into segments of equal length x, giving the required coupling capacitance $C_c=11$pF for plate width y=90 $\mu$m.

The rf source 135 includes a waveguide 96, an iris aperture 89 in the waveguide 96, and a stripline 95, shorted at one end and receiving rf signals from the waveguide through iris 89. Stripline 95 has a length equal to $\pi_g$, the guide wavelength of the rf signal. The stripline 95 is centered over iris 89 and has a dielectric constant $\epsilon_1$ and a thickness of $d_2$, equal to the thickness of stripline 94.

The resonant input circuit is driven by coupling power from a waveguide 96, within which rf power is propagating parallel to the cathode axis, into a stripline 95; terminating stripline 95 into stripline 94, and terminating stripline 94 into the resonant network 100 through coupling capacitances $C_c$. By adopting the same waveguide profile (WR42) for the input waveguide 96 as the waveguide 40 used for the output coupler, described infra in Section IV, the correct phasing of electron emission is obtained to achieve proper phase matching between the electron beam and the output coupler.

Power is coupled from waveguide 96 to stripline 95 through a capacitive iris 89, as shown in FIGS. 5B and 10. The iris radius is chosen to achieve the desired power coupling. Stripline 95 consists of a slab of quartz, with a dielectric constant $\epsilon_1=4\epsilon_0$, gold-metalized on both faces. The stripline preferably has a width equal to the cathode segment length x. The stripline dielectric thickness $d_2$ is chosen to produce a characteristic impedance $Z_2=50\ \Omega$:

$$Z_2 = Z_o\sqrt{\frac{d_2}{x}}\ \sqrt{\frac{\epsilon_o}{\epsilon}}$$

The thickness of stripline 94 is therefore chosen to be $d_2=0.35$ mm.

Referring now to FIGS. 5A, 5B and 10, power entering stripline 95 from waveguide 96 is matched to produce a left-going traveling wave by provision of a half-wave shorted stripline segment 107. The rf signal from waveguide 96 passes through iris 89 and into stripline 95. The signal traverses stripline 95 in both horizontal directions. The signal traveling to the right is reflected back to the left by shorted half-wavelength segment 107. The left-going traveling wave is then matched to the load $Z_L$ represented by network 100 by means of an intermediate stripline segment 94, whose length is a quarter-wavelength, and whose characteristic impedance is $$Z_1 = \sqrt{Z_L Z_2} = 10\ \Omega.$$

Such an impedance matching network 145 is standard practice in the art. See, for example, Bhartia and Bohl, *Millimeter Wave Engineering and Application*, p. 385 (Wiley 1984).

Stripline 95 can be fabricated with the same thickness $d_2$ and length as stripline 94, provided that the insulator of stripline 94 has a dielectric constant $\epsilon_s$:

$$\epsilon_s = \left(\frac{Z_2}{Z_1}\right)^2 \epsilon_1 = 100\ \epsilon_o$$

Calcium titanate has a dielectric constant approximately equal to 100 $\epsilon_0$. Thus striplines 94 and 95 simply abut end-to-end, with the conducting surfaces bridged by gold strips ultrasonically bonded to mating surfaces.

As shown in FIG. 10, a dc bias network 125 electrically connects to resonant network 100. The dc bias network is constructed in accordance with conventional techniques to provide the necessary dc offset to the resonant input coupler. Preferably, dc bias network 125 includes a diode accelerating voltage source V, a bias voltage source $V_d$ and a pair of choke inductors $L_c$. Inductors $L_c$ preferably connect the dc source to resonant network 100 by electrically connecting the first coupling inductor to the gate layer 141 of network 100 and the second coupling inductor to base layer 154 of network 100.

The input power $P_m$ required to drive each resonant network 100 is $$P_m=R(\omega C_1 V_m)^2/2=350\ \text{W}$$

In the overall cathode there are $N=2l/x=56$ couplers. Additional rf power is required to provide the emitted beam current I:

$$P_e = IV_m\frac{\sin(\Delta\phi/2)}{\pi} = 2.3\ \text{kW}.$$

The total drive power requirement is $P_{in}=NP_c+P_e=22$ kW. The rf gain of the gigatron is thus $$G=\log(P_{out}/P_{in})=27\ \text{db}.$$

Figure 12:
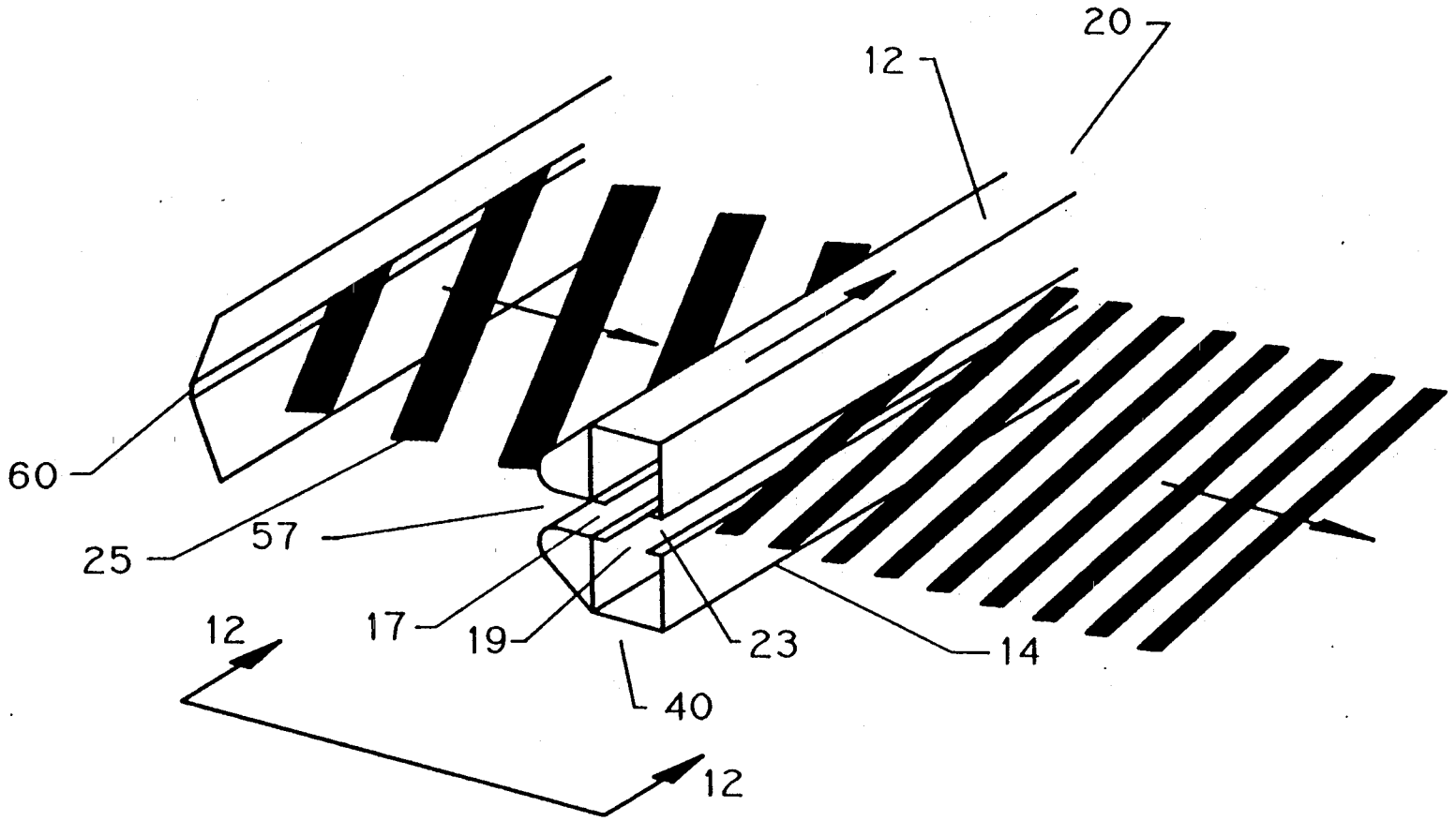
FIG. 12 is an isometric view of an output coupler for the gigatron shown in FIG. 4.

In the preferred embodiment of FIG. 12, wherein a tilted ribbon beam is desired as discussed more fully herein, the cathode 60 is divided lengthwise into a sequence of N equally spaced segments. The rf phase of successive segments matches the phase of the tilted ribbon beam as discussed infra, providing the phase velocity in the rf source waveguide equals that in the output waveguide coupler.

Figure 15:
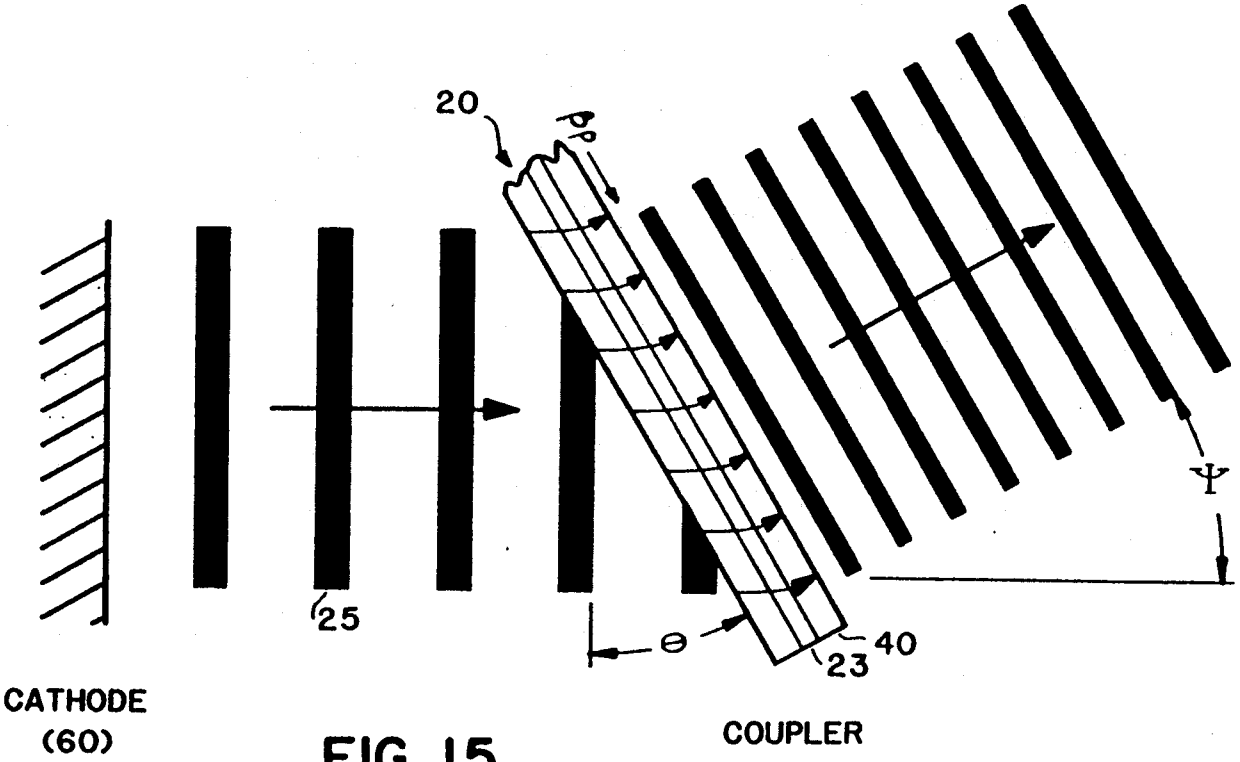
FIG. 15 is a diagram depicting the position of the output coupler shown in FIG. 14 relative to the ribbon beam for the alternative embodiment which compensates for magnetic deflection.

For the alternative embodiment of FIG. 15, the emission is required to be isochronous, which condition can be achieved by establishing waveguide 96 as a standing wave resonator and suitably adjusting the lengths of shorted stripline segments 107 to produce a constant phase in all coupler segments.

In another alternative embodiment, the resonant input coupler may comprise quartz fiber elements with a configuration other than a circular cross-section to improve series resistance. For example, a quartz fiber element with a generally rectangular cross-section, may be used without substantial modification.

In yet another alternative embodiment shown in FIG. 11, the input coupler may comprise a semiconductor stripline, as generally disclosed by Hasegawa, Hideki, et al., "Properties of Microstrip Line on $Si-SiO_2$ System", *IEEE Transactions on Microwave Theory and Techniques*. Vol. MTT-19, No. 11 (Nov. 1971). Referring to FIG. 11, the semiconductor stripline 105 comprises four layers of material in a stripline configuration. A gold base electrode 222 is deposited on the bottom surface of a semiconductor substrate 226 that is n-doped silicon and has a thickness D. An insulating layer 228, such as silicon dioxide, is deposited on the upper surface of semiconductor layer 226 with a thickness d. A gold gate electrode 224 is deposited on the upper surface of insulating layer 228. Field emitter tips are fabricated on the semiconductor surface following the procedure discussed in U.S. Pat. No. 4,307,507. Base electrode 222, gate electrode 224, semiconductor layer 226 and insulating layer 228 are all of a uniform width w.

As shown in FIG. 11, a field emitter array 85 is positioned on the stripline to emit electrons when a voltage $V_g$ is generated across the gate layer.

An approximate model of the semiconductor stripline is that the electric field appears across the gap d of the insulating layer, while current flow is through the conductors of the base and gate electrodes 222, 224 for an appropriate choice of semiconductor resistivity $\rho$ and stripline dimension d, w.

The electric field in the semiconductor substrate is about one-tenth of the electric field in the insulating layer. Consequently, the electric field energy in the insulating layer in comparable to that in the semiconductor, even though the volume of the insulating layer is much smaller. At the same time, the current flow in the semiconductor substrate is much less than the current flow in the base electrode.

As a result, the gap determining the capacitance is that of the insulating layer (d), while the gap determining the inductance is that of the semiconductor substrate (D). This makes it possible to obtain a convenient characteristic impedance Z even though the gate layer presents a very large distributed capacitance:

$$Z = Z_0 \sqrt{d\,D}\ /w$$

III. RIBBON BEAM GEOMETRY

The gigation preferably uses a ribbon electron beam to eliminate several inherent limitations present in round electron beam structures operating with high power at high frequency.

Referring now to FIG. 12, in the preferred embodiment the cathode 60 has a length l which is much greater than its height w. As a result, the cathode 60 emits an electron beam that has a ribbon-shaped configuration, with the length of the beam much greater than the height. As discussed in Section I, the cathode emits bursts of electrons periodically from the field emitter array according to the desired frequency, thus producing ribbons of electrons spaced a distance apart.

Adopting a ribbon beam configuration reduces space charge depression for a given beam current by a factor equal to the transverse aspect ratio (height/length). High beam currents are thereby readily achieved without space charge depression. The only problem with using a wide beam arises in output coupling to the beam. The wide beam has a length that may be much greater than the wavelength of the rf signal in the output coupler. If a standing wave output coupler were used, separated components of the wide electron beam would encounter alternately accelerating and decelerating electric fields, so that the coupler would be unable to efficiently extract a significant amount of energy from the beam. This problem is overcome by adopting the traveling wave coupler described in Section IV, infra.

In the preferred embodiment of the gigatron, a conventional rectilinear diode structure accelerates the ribbon electron beam. For the parameters of Table I, the diode voltage preferably is 200 kVDC with a diode spacing of 1.8 cm, and the cathode has dimensions $(14\times0.1)$ cm$^2$, with an emission current of 390 A peak.

Figure 13:
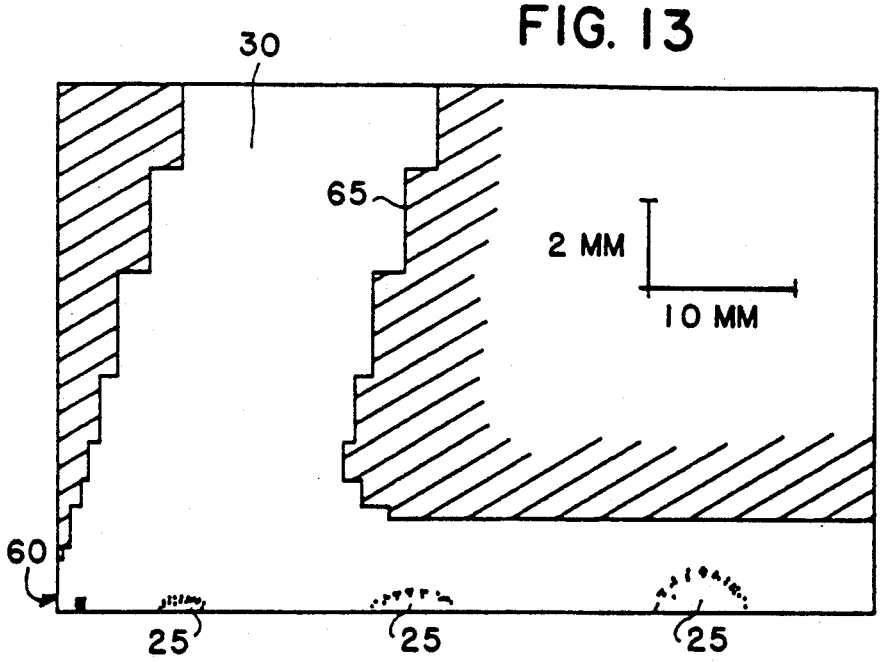
FIG. 13 shows the acceleration of a bunched beam through the diode region.

In operation, the diode accelerating voltage is pulsed on for the desired period to give the proper rf pulse duration. Use of pulsed diode voltage relieves problems that might otherwise arise from high-voltage breakdown and cathode leakage current. For continuous wave applications, constant diode voltage must be provided. Referring to FIG. 13, the acceleration of the bunched beam through the diode region 30 is calculated using the computer code, MASK. See, A. Pavelsky and A. T. Drobot, "Application of E-M P.I.C. Codes to Microwave Devices", Proc, 9th Conf. on Num. Sim. of Plasmas, PA-2, Northwestern University, Evanston, Ill, (1980).

Figure 18:
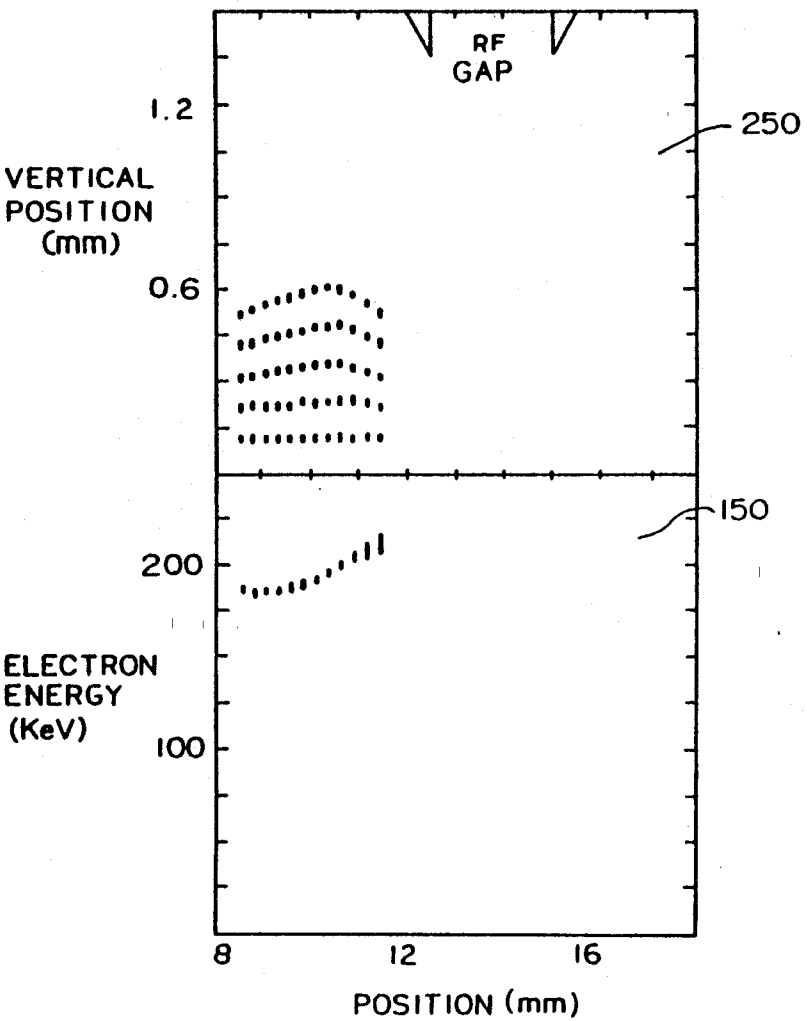
FIG. 18 is a graph of energy and bunch motion of electrons moving through the output coupler shown in FIG. 12.

Referring to FIGS. 4 and 12, the electron beam is emitted from the cathode 60, with a length that is much greater than its height, and travels in a direction transverse to the diode axis. The beam and the emission timing is modulated across the beam width with a phase velocity $\beta_p c$. The beam is accelerated by the diode structure into channel 57. The electron bunch expands somewhat during acceleration, as shown in FIG. 11, and fills approximately 70% of the cross-sectional height of the channel, without any significant debunching. The ribbon electron beam 25 then enters the output coupler 20 and energy is extracted from the beam. The beam exits from coupler 80 and passes into the collector 90. FIG. 18 illustrates the beam trajectory 250 through the output coupler. As shown in FIG. 18, approximately 74% of the electron energy 150 is extracted from the beam by the output coupler.

IV. TRAVELING WAVE COUPLER

Referring to FIG. 12, a traveling wave coupler 20, constructed in accordance with the principles of the present invention, is disposed downstream from a wide electron beam 25 emitted from cathode 60 and is positioned to extract energy from the electron beam. As described in Section III, the electron beam 25 is generally ribbon-shaped with a width which is much greater than its height and defines a ribbon axis along the width of the beam. The electrons which form the electron beam 25 are emitted in sequential bursts at a desired frequency to form ribbons of electrons with a phase width $\Delta\phi$, moving in a direction transverse to the ribbon axis.

Figure 14:
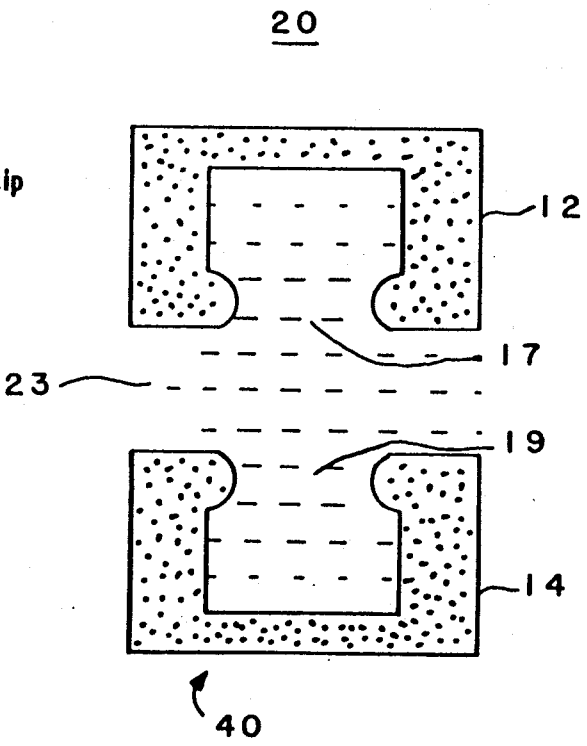
FIG. 14 is a side elevation of the output coupler in cross section taken along a line 12—12 in FIG. 12, showing calculated electric field distribution in the traveling wave.

The traveling wave coupler 20 includes a segment of waveguide 40 which is slot-coupled to the beam 25. Referring still to FIG. 12, the waveguide has a length which is equal to or greater than the length l of the electron beam 25. Referring now to FIG. 14, the waveguide 40 is slotted to form a pair of generally rectangular metal segments 12, 14, each having a C-shaped cross-section defining an opening 17, 19 along the length of one common face of the segments 12, 14. The two segments 12, 14 are positioned with the openings 17, 19 spaced and opposed along the length of the segments to define therebetween a slot 23 through which the electron beam 25 is passed. Slot 23 has an entrance into which the electron beam enters the waveguide and an exit through which the beam leaves the waveguide. The waveguide 40 is excited in a transverse electric ($TE_{10}$) mode by well known means to provide an electric field E in the traveling wave coupler 20 which decelerates the electron beam and thereby removes energy from the electron beam. As shown in FIG. 14, the electric field E emanates perpendicularly along the longitudinal axis of the waveguide 40. In addition, the electric field distribution radiates uniformly from the entrance of the waveguide to the exit.

Referring again to FIG. 12, exciting the waveguide 40 establishes an rf traveling wave in the coupler 20 which travels at a phase velocity $\beta_p c$ along the waveguide (where $c=3\times10^8$ m/s). Meanwhile, the electron ribbon beam is accelerated according to conventional techniques in a rectilinear dc diode, to a velocity of $\beta_e c$. The beam 25 passes through the slot 23, where the beam is decelerated by the electric field E in the coupler 20.

The traveling wave coupler 20 is positioned to define an angle $\Theta$ with respect to the ribbon beam axis of the electron beam as illustrated in FIGS. 12 and 15. The phase-matching condition between the beam angle $\Theta$, the electron velocity $\beta_e$, and the waveguide phase velocity $\beta_p$ is given as:

$$\Theta = \arctan \frac{\beta_e}{\beta_p}$$

Tilting the ribbon beam orientation by the proper angle Θ with respect to the waveguide beam axis permits the electron beam 25 to drive the traveling wave in the waveguide 40 at a constant phase across an arbitrarily wide beam. As the rf traveling wave $\beta_p$ moves down the waveguide 40, positioned an angle Θ with respect to the electron beam 25, the traveling wave field opposes the ribbon electron beam along the entire width of the beams thereby increasing the energy of the rf traveling wave. The electron beam, therefore, essentially "surfs" on the rf traveling wave as the traveling wave moves down the waveguide.

In the preferred embodiment shown in FIG. 10, the electrons may be sequentially emitted by the cathode 60 in such a manner that the electron beam 25 forms the appropriate angle Θ with the traveling wave coupler 20. Accordingly, in this embodiment, the cathode 60 must be phased to emit each electron at a specific time to obtain the angle Θ0 between the beam 25 and traveling wave coupler 20 as disclosed in Section I, supra.

The traveling wave in waveguide 40 also generates an in-phase magnetic field B where:

$$B = E/\beta_p c.$$

As the ribbon electron beam 25 passes through the slot 23 in the traveling wave coupler 20, the direction of the electrons is altered by an angle Ψ due to the in-phase transverse magnetic field B of the traveling wave, where:

$$\Psi = c \int \frac{Bdl}{meV} = \frac{gE_o \cos \phi}{\beta_p \sqrt{meV}} \quad (\phi = \text{phase of the traveling wave})$$

Referring again to FIGS. 12 and 15, the electron ribbon beam enters the waveguide in phase with the traveling rf wave. The direction of the electrons is deflected by an angle Ψ and the beam leaves the waveguide 40 in a direction different than the direction at which the electrons entered the waveguide.

The majority of the beam energy is coupled into the traveling rf wave immediately before exiting from the waveguide 40. In the preferred embodiment of FIG. 12, the magnetic bending of the electrons changes the beam direction so that it is no longer parallel to the electric field E radiating from the waveguide 40. Consequently, the maximum efficiency of the output coupler is limited by this effect.

An alternative embodiment of the traveling wave coupler makes it possible to compensate for the above-described magnetic bending. Referring to FIG. 15, the electron ribbon beam can be produced with ribbon wavefronts perpendicular to the direction of motion with simultaneous emission across the entire cathode length. The output coupler can be tilted by an angle Θ with respect to the beam to achieve the phase-matching condition of $\Theta = \arctan \beta_e/\beta_p$. The electron beam is then deflected magnetically by the angle Ψ (≃Θ) so that it exits the coupler correctly aligned parallel to the waveguide electric field. Somewhat higher conversion efficiency can thereby be achieved in this alternative embodiment.

FIG. 18 illustrates both the trajectory and electron energy of successive ribbon beams through the coupler region for a gigatron with the parameters of Table I constructed in accordance with the preferred embodiment. On the upper graph 150, trajectories are shown on five points across each ribbon beam. After passing through the coupler, the beam is deflected, but not intercepted, by the traveling wave coupler. On the lower graph 250, the electron energy for each beam is shown. According to the graph, the coupler extracts 74 percent of available electron energy. This performance is unparalleled by any other known device.

Figure 16:
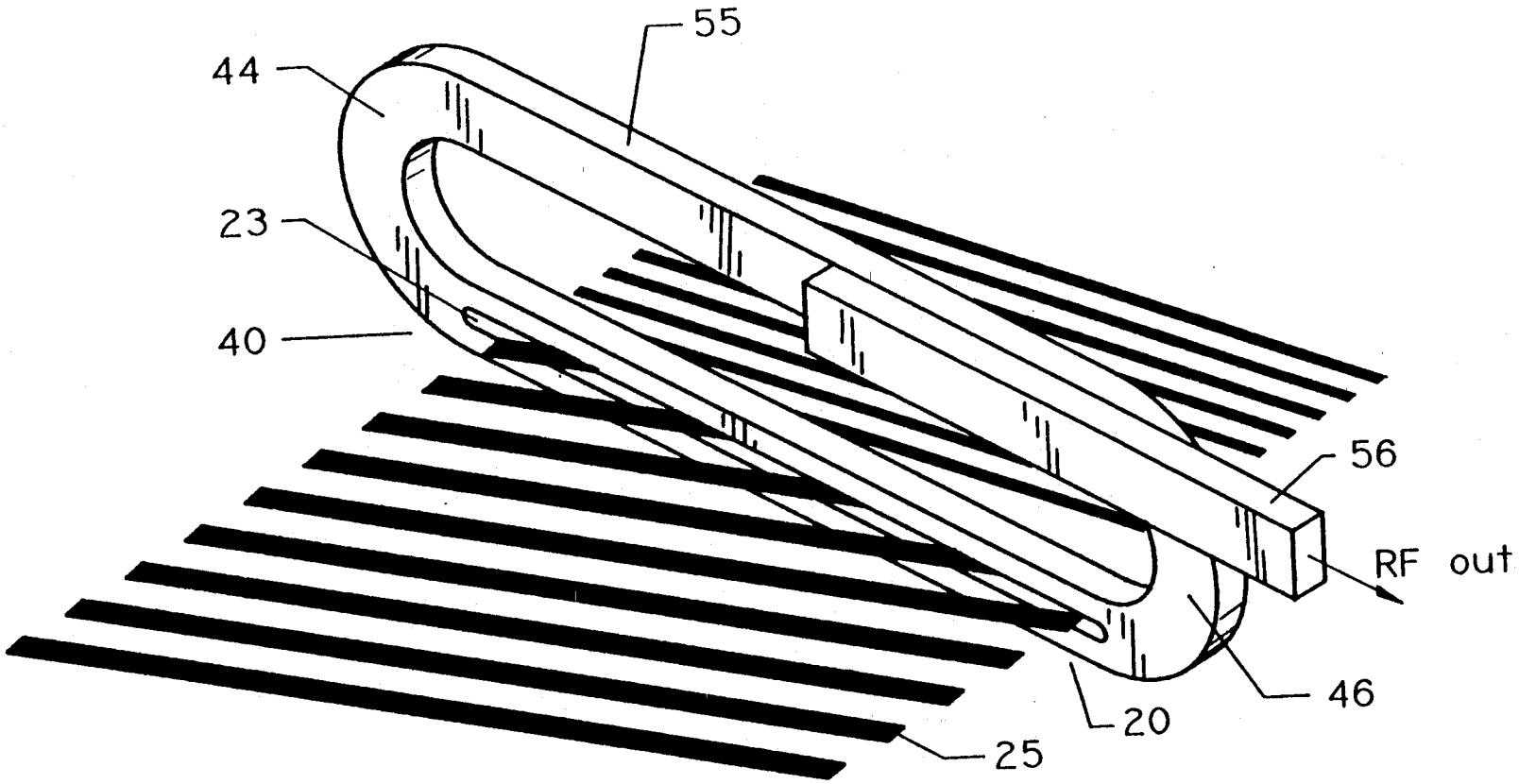
FIG. 16 is a schematic diagram illustrating the use of a loop resonant circuit in the output coupler.

Referring now to FIG. 16, the traveling wave coupler 20 which is used to decelerate the electron beam in the waveguide coupler is generated by the beam itself. The traveling wave coupler 20 must return sufficient beam energy back into the waveguide 40 to generate and sustain the required decelerating field E. In the preferred embodiment of FIG. 14, the traveling wave coupler is closed upon itself externally to form a loop-resonant circuit 63 including two semicircular pieces of waveguide 44, 46 and a straight piece of waveguide 55. The two semicircular pieces of waveguide 44, 46 have an arc of 180 degrees and are used to connect both ends of the coupler 20. A straight waveguide 55 connects to both semicircular waveguides 44, 46 to complete the resonant circuit. Straight waveguide 56 is aperture-coupled to the loop-resonant circuit so that power can be extracted.

The required $Q_l$ for the loop resonant circuit is $$Q_l = \omega \frac{[\text{stored energy}]}{[\text{output power}]} = \omega \frac{[\epsilon_o E_o^2 g^2 al/b]}{P_o} = 1150$$

The unloaded $Q_u$ for the $TE_{10}$ mode is:

$$Q_u = \omega\beta_p / c\alpha = 3000$$

where $\alpha = 0.4$ dB/m $= 0.17$ m$^{-1}$ is the attenuation constant of the WR42 waveguide at 18 GHz. The waveguide resonant loop is thus capable of sustaining the required decelerating field, with a power efficiency of $Q_u/(Q_u+Q_l) = 72\%$.

As electrons are decelerated against the electric field of the traveling wave, the resulting field energy will in principle propagate equally in both directions in the waveguide coupler. The traveling wave propagating in the direction at which the ribbon beam is arriving at the coupler, according to the orientation of the waveguide with respect to the beam, coherently drives the stored traveling wave, as described sucra. The traveling wave propagatinq in the opposite direction is driven with a phase which alternates from accelerating to decelerating for successive beam components across the width of the ribbon beam. The ribbon beam energy will therefore, on the average, be transferred uniquely to the traveling wave selected by the tilt orientation of the electron beam.

The traveling wave coupler naturally suppresses all parasitic modes. The resonant loop of waveguide has a total length chosen to be an integral number M of phase wavelengths:

$$2l = 2\pi M \frac{\beta_p c}{\omega}$$

For the parameters of Table I, an appropriate choice would be M = 14. In principle, parasitic modes could be excited at frequencies corresponding to neighboring integral harmonics $M' \neq M$. The coupling to each mode M, must, however, be averaged over the length l of the ribbon beam. If the ribbon beam tilt is adjusted to achieve the phase-match condition of $\Theta = \arctan \beta_e/\beta_p$ for harmonic M, the phase shifts between the electron bunch and a traveling wave of harmonic M' varies linearly along the ribbon beam:

$$\Delta\phi = 2\pi(M' - M)\frac{(x)}{2l}$$

Averaging over the width l of the ribbon gives a coupling for each parasitic mode:

$$\frac{E}{Eo} = \int_o^l (\cos \Delta\phi)\frac{dx}{l} = \begin{cases} 0 & M' \neq M \\ 1 & M' \neq M \end{cases}$$

All parasitic modes $M' \neq = M$ thus receive no net coupling. This feature is a result of the distributed beam waveguide coupling, and is unique among electron tube designs.

Figure 17:
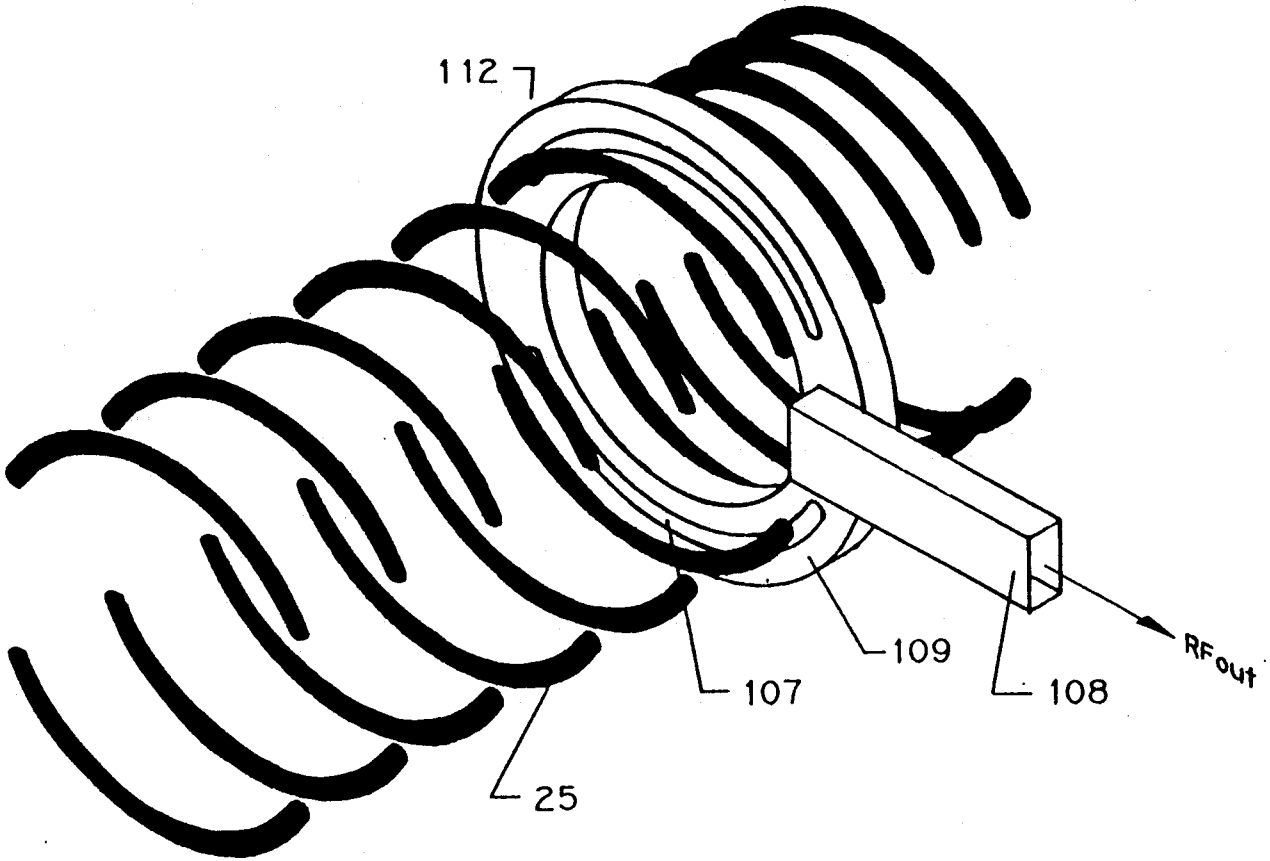
FIG. 17 is a schematic diagram illustrating an alternative embodiment of the loop resonant circuit shown in FIG. 16.

In an alternative embodiment, the ribbon electron beam may comprise a thin circular ring with an arcuate gap at the bottom of the ring. Referring now to FIG. 17, the output coupler used to couple a ring beam includes circular waveguide ring section 112 positioned as described sucra with respect to the beam. Bottom and top arcuate sections of waveguide 109, with slot aperture 107, form the loop resonant circuit. The traveling wave traverses through the loop resonant circuit as described, supra. Output power is obtained by slot-coupling circular waveguide ring 112 to an external waveguide 108 at an aperture (not shown) in waveguide ring 112.

Many other alternative embodiments to the present invention will be readily apparent. In addition, a variety of ribbon beam configurations can be used, such as a helical or cylindrical beam.

V. MEGATRON AMPLIFIER

In an alternative embodiment, a medium power electron tube, called a megatron, may be constructed for operation at power levels of 10 kw to 200 kw with extremely high efficiency. The megatron uses the resonant input coupler 50 and field emitter array 85, described in Sections I and II, supra, as the cathode to modulate a round electron beam. Energy is extracted from the round beam in accordance with U.S. Pat. No. 4,313,071, which is incorporated by reference herein.

Figure 19:
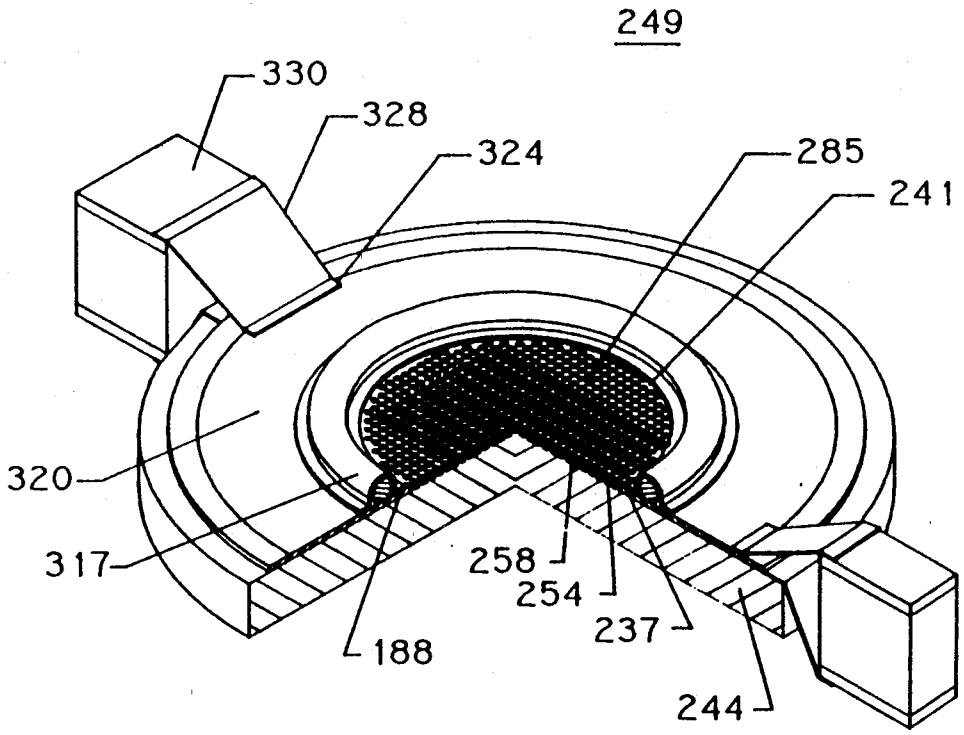
FIG. 19 is an isometric view of a cathode in the megatron.

Referring now to FIG. 19, a specific design of a megatron will be described, which has the parameters listed in Table II. Similar designs can be optimized for frequencies between 10–30 GHz, with output power between 10–200 kw.

TABLE II

| Parameters of Example Megatron | | |
|---|---|---|
| $\omega/2\pi$ | rf frequency | 12 GHz |
| $P_o$ | rf peak power | 36 kw |
| G | power gain | 33 dB |
| | rf efficiency | 80% |
| V | beam voltage | 200 kVDC |
| I | peak beam current | 1.3 A |
| $\phi$ | rf phase | 230° |
| $\Delta\phi$ | beam phase width | 60° |
| | cathode radius | 0.4 mm |

The cathode of the megatron includes a field emitter array 285 modulated by a lumped-constant resonant input coupler 249. In the preferred embodiment of the megatron, field emitter array 285 has a circular emitting surface surrounded by the resonant input coupler 249.

According to the principles described in Section I, supra, and referring to FIG. 6, the field emitter array includes a semiconductor substrate 244, with emitter pyramids 237. Base layer 254 of aluminum rests on semiconductor substrate 244, around pyramids 237. An insulating layer 258, such as silicon dioxide, is deposited on base layer 254. A gate electrode 241 of gold forms a grid over the surface of the array 285. The outer edge of gate electrode 241 comprises a gate connector 188 for connection to the resonant input coupler. Gate connector 188 is electrically connected to gate electrode 24.

According to the principles described in Section II, sucra, and referring to FIG. 19, the resonant input coupler 249 comprises an inductive element 204, a tuning capacitor 205, capacitive couplings 233, transmission lines 294, and waveguide 330. The equivalent circuit of the resonant input coupler is shown in FIG. 10. DC bias voltage $V_g$ is applied through rf choke $L_c$. The rf current required to modulate the gate/base junction is provided by the resonant circuit formed by $C_1$, L, and $C_2$. The choice of parameters follows closely the discussion in Section II, supra, and is not repeated here. The choice of output power, given the field-emission characteristic of FIG. 9 and a tip spacing of 6 μm, yields a cathode radius of 0.5 mm. The parameters of the required input coupler are $C_l = C_2 = 200pF$
$C_c = 0.6pF$
$L = 20pH$
$R = 1.0 \times 10^{-2}\ \Omega$
$Q = 140$
$Z_L = 50\ \Omega$
$G = 33db$ The load impedance is matched according to conventional techniques for coupling to a waveguide termination, as indicated in FIG. 19.

Referring now to FIG. 4, the electrons emitted from array 285 are accelerated through a standard diode configuration by a high voltage provided between the cathode 60 and anode 65, in accordance with U.S. Pat. No. 4,313,072. The beam then traverses a standing wave coupler, resonating in the $TM_{010}$ mode at the desired frequency of operation, and phased so as to optimally decelerate the beam. The standing wave coupler absorbs energy from the beam by creating an rf electric field which is phased to decelerate the beam. Radio frequency power is removed from the standing ware coupler by means of a coupling loop.

In an alternative embodiment, the gated field emitter cathode and resonant input coupler can be utilized to produce a modulated electron beam which is then further accelerated by sequences of rf cavities. This embodiment would constitute a modulated electron gun, and could be used as a single compact beam source for a variety of applications, including electron linacs, free-electron lasers, x-ray sources, and linac colliders. The alternative embodiment could be realized either with the round cathode of FIG. 19 or the ribbon cathode of FIG. 5, according to the particular requirements of the application.

While the preferred embodiment of the invention has been disclosed, numerous alternative embodiments can be made by one skilled in the art without departing from the spirit of the invention.

I claim:

1. A microwave amplifier for extracting an amplified output signal at a desired frequency, comprising:

a cathode with a ribbon-shaped configuration;

a collector;

means for modulating said cathode to emit an electron beam with a ribbon-shaped configuration at the desired frequency, said electron beam defining a beam path between said cathode and said collector;

means for coupling to the electron beam and extracting energy from the electron beam, said means for coupling being positioned to intersect the electron beam in said beam path;

wherein said means for coupling includes means for generating a traveling RF wave, which traverses said means for coupling and produces an electric field at said means for coupling that decelerates the electron beam at each point along the beam.

2. A microwave amplifier according to claim 1, wherein said cathode comprises a field emitter array.

3. A microwave amplifier according to claim 2, wherein said means for modulating comprises an input coupler connected to said field emitter array.

4. A microwave amplifier according to claim 3, wherein said input coupler includes a first inductive element positioned along a first side of said field emitter array and a second inductive element positioned along a second side of said field emitter array.

5. A microwave amplifier according to claim 3, wherein said input coupler includes an inductive channel positioned along a side of said field emitter array.

6. A microwave amplifier according to claim 4, wherein said input coupler also includes, a first tuning capacitor electrically connected to said first inductive element and a second tuning capacitor electrically connected to said second inductive element.

7. A microwave amplifier according to claim 6, wherein said field emitter array includes a base electrode, a gate electrode and an insulating layer;

said first inductive element and said second inductive element electrically connect to said gate electrode.

8. A microwave amplifier according to claim 3, wherein said input coupler comprises a semiconductor stripline.

9. A microwave amplifier according to claim 3, wherein said input coupler comprises a quartz fiber and a tuning capacitor;

said field emitter array includes a gate electrode, an insulating layer and a base electrode;

said tuning capacitor includes a top plate, a dielectric and a bottom plate;

said quartz fiber electrically connects to the gate electrode and to the top plate of said tuning capacitor;

the bottom plate of said first and second tuning capacitor electrically connects to the base electrode of said field emitter array.

10. A high efficiency electron tube, comprising:

means for generating a ribbon-shaped electron beam;

input means coupled to said generating means for providing an RF signal to said generating means so that said generating means emits electrons in bursts according to the frequency of the RF signal;

means for extracting energy from said ribbon-shaped electron beam, wherein said extracting means includes a waveguide tilted at an angle with respect to said electron beam, and said waveguide is excited to provide an electric field in the region of said extraction means which decelerates the electron beam.

11. An electron tube as in claim 10, wherein said waveguide also generates a magnetic field which deflects the direction of the electron beam, and the angle between the beam and the waveguide is approximately equal to the angle of deflection caused by the magnetic field.

12. An electron tube according to claim 10, wherein said means for extracting comprises a slotted waveguide.

13. An electron tube according to claim 12 wherein a traveling wave traverses said waveguide with a velocity $\beta_p$;

said electron beam travels toward said waveguide with a velocity $\beta_e$; and said waveguide is tilted with respect to said electron beam by an angle $$\Theta = \arctan \frac{\beta_e}{\beta_p}.$$

14. An electron tube, comprising:

a field emitter array cathode;

means for modulating said cathode to emit beams of electrons at a desired frequency;

said cathode structured to emit electrons in a ribbon-shaped beam configurations with a front face of said beam;

an output coupler for receiving the electron beam and extracting energy therefrom;

an rf wave modulating at the desired frequency traveling in said output coupler and generating a decelerating electric field in said coupler;

said output coupler being tilted at an angle greater than 0° and less than 90° with respect to the face of said beam to receive said ribbon-shaped electron beam in phase with said decelerating electric field.

15. A traveling wave coupler for extracting energy from a wide electron beam traveling at a velocity $\beta_c$, comprising:

means for receiving the wide electron beam, with said means for receiving being tilted at an angle $\Theta$ with respect to said electron beam;

means for generating a traveling wave in said receiving means, to provide an electric field in the receiving means, said traveling wave traversing said receiving means at a velocity $\beta_p$, wherein the traveling wave and the electron beam couple in phase at said receiving means by positioning the receiving means at an angle $$\Theta = \arctan \frac{\beta_e}{\beta_p}$$

with respect to the electron beam.

16. A traveling wave coupler as in claim 15, wherein said receiving means comprises a segment of waveguide.

17. A traveling wave coupler as in claim 16, wherein said segment of waveguide is slot coupled to the electron beam.

18. A traveling wave coupler as in claim 16, wherein said receiving means includes a first structure and a second structure, said first structure spaced from said second structure to define therebetween a slot for receiving the electron beam passing through said receiving means at said slot.

19. A traveling wave coupler as in claim 16, wherein said receiving means includes a slot in said segment of waveguide through which the electron beam passes.

20. An electron tube according to claim 14, wherein the rf wave travels in said output coupler with a velocity $\beta_p$;

said electron beam travels toward said output coupler at a velocity $\beta_e$; and the angle at which said output coupler is tilted with respect to the electron beam is an angle $$\Theta = \arctan \frac{\beta_e}{\beta_p}.$$

21. A traveling wave coupler for extracting energy from an electron beam, comprising:

means for receiving the electron beam;

means for generating a traveling wave in said receiving means, wherein the traveling wave and the electron beam couple in phase at said receiving means;

wherein the electron beam is emitted at an angle $\Theta$ with respect to said receiving means, said angle being determined as follows:

$$\Theta = 180^\circ - \arctan \frac{\beta_e}{\beta_p}$$

wherein $\beta_e$ is the velocity of the electron beam and $\beta_p$ is the velocity of the traveling wave.

22. A traveling wave coupler as in claim 21 wherein said electron beam is altered as it passes through said receiving means and said angle also compensates for the altering of said beam.

23. A waveguide for extracting energy from an electron beam, comprising:

an electric field in said waveguide for decelerating the electron beam as the electron beam passes through said waveguide;

a traveling wave moving through said waveguide;

said waveguide being positioned at an angle with respect to said beam so that the electron beam and traveling wave couple along said waveguide;

wherein the positioning of said waveguide at said angle also compensates for deflection of the electron beam as said beam passes through said waveguide.

24. A traveling wave coupler for extracting energy from an electron beam, comprising:

a waveguide for receiving the electron beam;

a traveling wave in said waveguide;

said waveguide defining an angle of incidence with respect to the electron beam so that the traveling wave extracts energy from the electron beam along said waveguide; and a loop resonant circuit connected to said waveguide.

25. A traveling wave coupler as in claim 24 wherein the electron beam has a ribbon-shaped configuration, and said waveguide has a slot for receiving said ribbon-shaped electron beam.

26. A traveling wave coupler as in claim 25 wherein said electron beam is in phase with said traveling wave.

27. A traveling wave coupler as in claim 24 wherein said traveling wave coupler generates a magnetic field which alters the direction of the electron beam at an angle approximately equal to said angle of incidence.

28. A wave coupler for extracting energy from an electron beam, comprising:

a waveguide for receiving said electron beam;

said wave coupler generating a magnetic field which bends said electron beam as it passes through said waveguide; and said waveguide positioned at an angle with respect to the electron beam to compensate for the bending of said electron beam as it passes through said waveguide.

29. A wave coupler as in claim 28 further comprising a traveling wave in said waveguide, said traveling wave being driven in phase with said electron beam as said traveling wave moves along said waveguide.

30. A wave coupler in accordance with claim 28, wherein the angle between the waveguide and the face of the electron beam is between 0° and 90°.

* * * * *